US008953963B2

(12) United States Patent
Nakagawa et al.

(10) Patent No.: US 8,953,963 B2
(45) Date of Patent: Feb. 10, 2015

(54) DEVELOPING DEVICE, IMAGE FORMING APPARATUS, AND METHOD FOR CONTROLLING DEVELOPING DEVICE

(71) Applicant: KYOCERA Document Solutions Inc., Osaka (JP)

(72) Inventors: Tatsuya Nakagawa, Osaka (JP); Tadahiro Kiyosumi, Osaka (JP); Kensuke Fujihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 85 days.

(21) Appl. No.: 13/743,514

(22) Filed: Jan. 17, 2013

(65) Prior Publication Data

US 2013/0183053 A1 Jul. 18, 2013

(30) Foreign Application Priority Data

Jan. 18, 2012 (JP) ..... 2012-007941

(51) Int. Cl.
*G03G 15/06* (2006.01)
*G03G 15/09* (2006.01)

(52) U.S. Cl.
CPC ..... *G03G 15/0907* (2013.01); *G03G 15/065* (2013.01)
USPC ..... 399/55

(58) Field of Classification Search
USPC ..... 399/55, 222, 229, 235, 37, 88
See application file for complete search history.

(56) References Cited

U.S. PATENT DOCUMENTS

2004/0051513 A1* 3/2004 Rupp et al. ..... 323/288
2010/0129102 A1* 5/2010 Fujihara et al. ..... 399/55
2011/0020028 A1* 1/2011 Okumura ..... 399/88

FOREIGN PATENT DOCUMENTS

JP 2006-221107 A 8/2006

OTHER PUBLICATIONS

English Abstract and Translation for JP 2006-221107 A, published Aug. 24, 2006.

* cited by examiner

*Primary Examiner* — Clayton E Laballe
*Assistant Examiner* — Ruifeng Pu
(74) *Attorney, Agent, or Firm* — NDQ&M Watchstone LLP

(57) ABSTRACT

A developing device includes a developing roller, a magnetic roller, a capacitor, a transformer, and a switching portion. The magnetic roller supplies toner to the developing roller or takes off the toner from the same. The capacitor is connected to a primary of the transformer, and the developing roller is connected to a secondary of the same. During a period while the voltage between electrodes of the capacitor is changing, the switching portion changes the duty ratio in a predetermined second time slot in which current flowing in the switching portion is smaller than that flowing in a first time slot.

15 Claims, 10 Drawing Sheets

DEVELOPING DEVICE, IMAGE FORMING APPARATUS, AND METHOD FOR CONTROLLING DEVELOPING DEVICE

CROSS-REFERENCE TO RELATED APPLICATIONS

This application is based on and claims the benefit of priority from Japanese Patent Application No. 2012-007941 filed on Jan. 18, 2012, the contents of which are hereby incorporated by reference.

BACKGROUND

The present disclosure relates to a developing device for developing an electrostatic latent image using toner, and an image forming apparatus including the developing device.

There is an image forming apparatus such as an multifunction peripheral, a copier, a printer, or a facsimile, which develops with toner an electrostatic latent image formed on a photosensitive drum so as to perform printing. Further, there is an image forming apparatus which uses a developer containing magnetic carrier and toner (so-called two-component developer). Further, in the developing process using the two-component developer, it is not appropriate for a magnetic brush of the carrier to directly contact with the photosensitive drum from viewpoints of image quality and the like. Therefore, there is known an image forming apparatus including the developing device of a type including a developing roller opposed to the photosensitive drum so as to carry the toner, in which a magnetic roller opposed to the developing roller forms the magnetic brush so that only the toner is transferred to the developing roller by the magnetic brush. Thus, the magnetic brush does not contact with the photosensitive drum when developing the electrostatic latent image (This may be referred to as "touch down developing" or "hybrid developing"). This method is advantageous to a one-component developing method or a conventional two-component developing in various points such as image quality, printing speed, life of toner, carrier scatterproof, and the like.

In the touch down developing method as described above, alternating voltage (for example, approximately 1 to 2 kV in peak-to-peak voltage) is applied to the developing roller. In this way, the charged toner is scattered for developing the electrostatic latent image. Further, there is a case where a signal indicating ON/OFF of conduction (switching) is generated using a switching element such as a transistor, a DC component of the signal is removed using a capacitor, the signal is supplied to a primary of a transformer, and the alternating voltage to be applied to the developing roller is obtained from a secondary of the transformer.

Here, there is a case where a duty ratio of the switching should be changed from a viewpoint of preventing occurrence of leakage (discharge) between the photosensitive drum and the developing roller or preventing occurrence of an uneven toner image. However, when the duty ratio of the switching is changed, an imbalance voltage (having offset energy) is applied to the transformer. As a result, asymmetric magnetization may occur in the transformer. When the asymmetric magnetization occurs so that magnetic flux is biased, the transformer becomes in such a DC biased state. Then, current larger than rated current (overcurrent) may flow, and hence there is large probability that the switching element is broken down. In particular, as a transient variation of the duty ratio is larger, larger asymmetric magnetization occurs so that larger current is apt to flow in the switching element.

Further, when the duty ratio is once changed, voltage between electrodes of the capacitor is periodically fluctuated due to energy oscillation between the primary of the transformer and the capacitor. Further, in relation to this energy oscillation, there is a problem that when the duty ratio is changed during a period of the fluctuation of the voltage between electrodes of the capacitor, there is a timing (time slot) in which large current flows in the switching element.

Note that in the above-mentioned known image forming apparatus, a hybrid developing device is realized which is advantageous in points such as image quality, life of toner, carrier scatterproof, printing speed, and the like, without adding a new member or the like. However, the apparatus does not resolve the problem that there is possibility that large current may flow in the switching element when the duty ratio of switching is changed in the switching element.

SUMMARY

In view of the above-mentioned problem, the present disclosure prevents large current from flowing in the switching element and enables to reach a desired duty ratio quickly without a problem, in any stage of changing the duty ratio when the duty ratio is changed step by step in a plurality of steps.

In order to solve the above-mentioned problem, a developing device according to a first aspect of the present disclosure includes a developing roller, a magnetic roller, a capacitor, a transformer, and a switching portion. The developing roller carries toner and is opposed to a photosensitive drum. The magnetic roller is disposed to be opposed to the developing roller, supplies the toner to the developing roller by a magnetic brush, and takes off the toner from the developing roller. The transformer includes a primary connected to the capacitor and a secondary delivering alternating voltage to be applied to the developing roller. The switching portion includes a control signal generating portion for generating a control signal and a switching element connected to the capacitor so as to turn on and off current to a serial circuit of the capacitor and the transformer based on the control signal. In addition, the switching portion changes a duty ratio of the control signal step by step continuously in a plurality of steps toward a target duty ratio. After the duty ratio is changed, during a period for voltage between electrodes of the capacitor to fluctuate due to the change of the duty ratio, the switching portion changes the duty ratio in a predetermined second time slot in which current flowing in the switching portion is smaller than that flowing in a first time slot.

Further features and advantages of the present invention will become apparent from the description of embodiments given below.

BRIEF DESCRIPTION OF THE DRAWINGS

FIG. 10 is a flowchart illustrating an example of process flow for changing the duty ratio of a control clock signal or the like.

DETAILED DESCRIPTION

Hereinafter, an embodiment of the present disclosure is described with reference to FIGS. 1 to 10. This embodiment describes an example of a tandem electrophotographic printer 100 (corresponding to the image forming apparatus) including a developing device 1. However, elements of a structure, a layout, and the like described in this embodiment are merely examples for description and should not be interpreted to limit the scope of the disclosure.

(Outline of Image Forming Apparatus)

Figure 1:
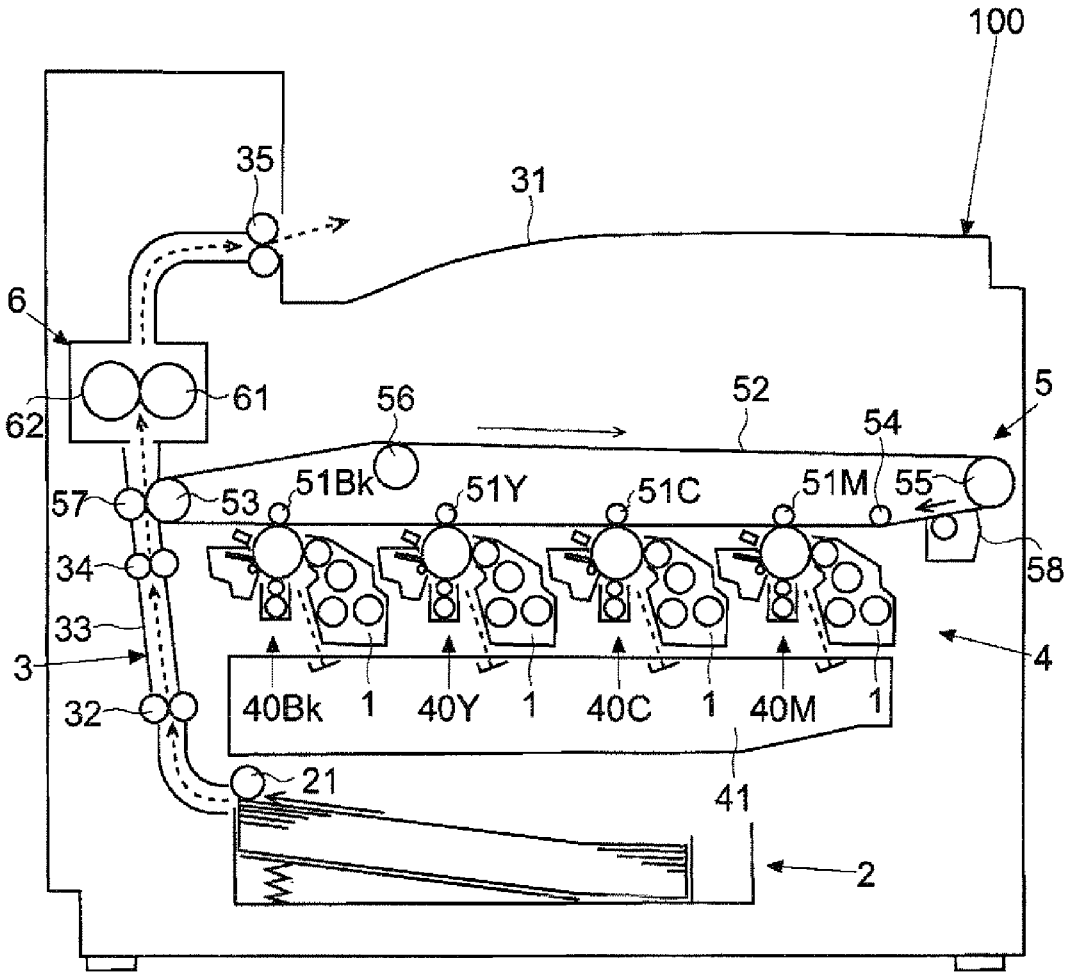
FIG. 1 is a cross-sectional view illustrating a structure of a printer.
Figure 2:
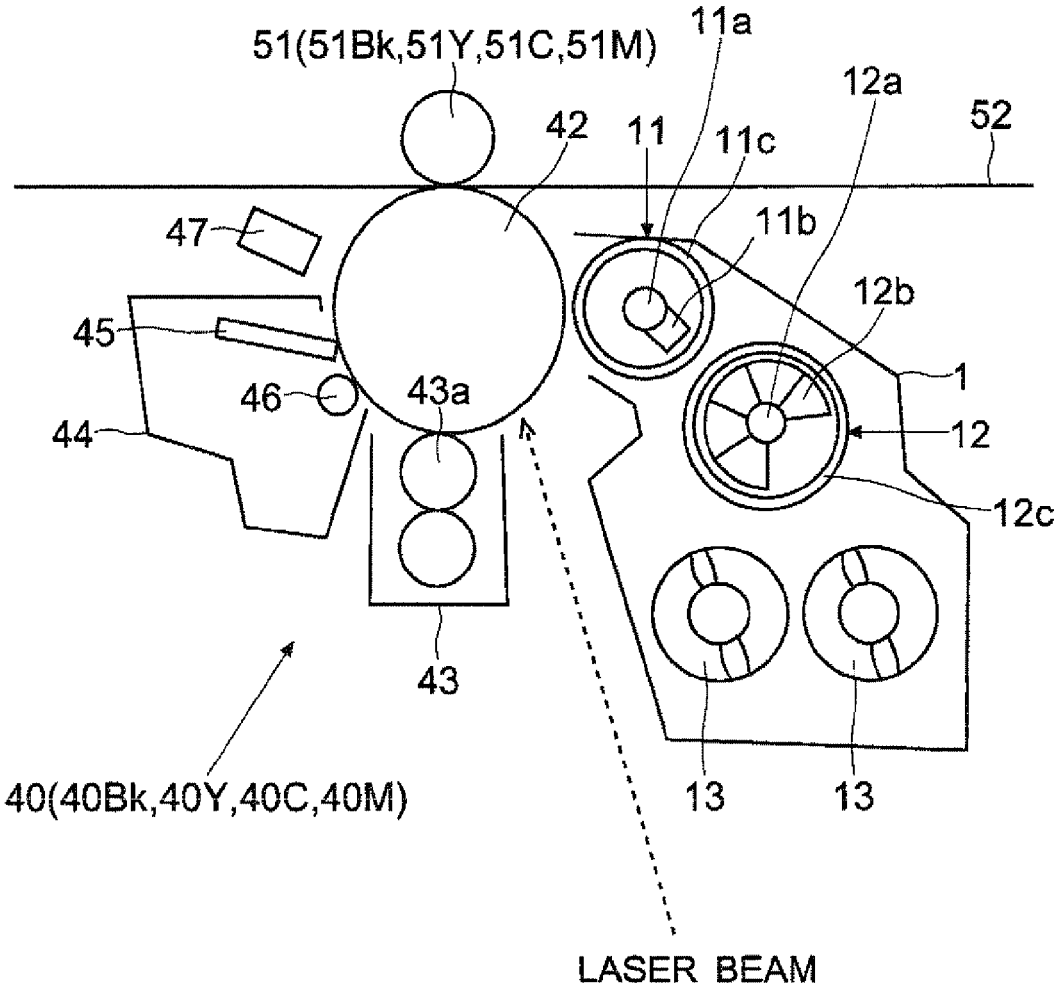
FIG. 2 is a cross-sectional view of an image forming unit.

First, with reference to FIGS. 1 and 2, an outline of the printer 100 according to the embodiment is described. FIG. 1 is a cross-sectional view illustrating a structure of the printer 100. FIG. 2 is a cross-sectional view of an image forming unit 40.

As illustrated in FIG. 1, the printer 100 of this embodiment includes in its main body a paper sheet feeder 2, a transport portion 3, an image forming portion 4, an intermediate transfer portion 5, a fixing portion 6, and the like.

For instance, the paper sheet feeder 2 contains various paper sheets such as plain paper sheets (OA paper sheets), OHP sheets, label paper sheet, and the like. The paper sheet feeder 2 is equipped with a paper feed roller 21 that is driven to rotate by a drive mechanism (not shown) such as a motor and feeds the paper sheets one by one to the transport portion 3. Further, the transport portion 3 guides the sheet fed from the paper sheet feeder 2 to a discharge tray 31 via the intermediate transfer portion 5 and the fixing portion 6. The transport portion 3 is equipped with a transport roller pair 32, a guide 33, a registration roller pair 34 for letting the transported sheet to wait before the intermediate transfer portion 5 and sends out the same in synchronization with timing, a discharge roller pair 35, and the like.

Based on image data of an image to be formed, the image forming portion 4 forms a toner image. Further, the image forming portion 4 includes image forming units 40Bk to 40M of four colors and an exposing device 41. Specifically, the image forming portion 4 includes an image forming unit 40Bk for forming a black image, an image forming unit 40Y for forming a yellow image, an image forming unit 40C for forming a cyan image, and an image forming unit 40M for forming a magenta image.

Here, with reference to FIG. 2, the image forming units 40Bk to 40M are described in detail. Note that the image forming units 40Bk to 40M form images of different colors but have basically the same structure. Therefore, the image forming unit 40Bk is exemplified, and symbols Bk, Y, C, and M indicating colors are omitted unless otherwise noted, in the following description. In addition, the same members are denoted by the same numerals or symbols in an image forming unit 40.

The image forming unit 40 includes a photosensitive drum 42. The photosensitive drum 42 is supported in a rotatable manner. The photosensitive drum 42 is driven by a motor 74 (see FIG. 3) to rotate at a predetermined circumferential speed. For instance, the photosensitive drum 42 includes a base made of a metal such as aluminum and a photosensitive layer made of OPC (may be amorphous silicon or the like) formed on the outer circumference surface. Further, the photosensitive drum 42 carries a toner image (as an image carrier) on the circumference surface by charging, exposing, and developing processes. Note that the photosensitive drum 42 of this embodiment is a positive charge type (and therefore, toner that is positively charged is also used).

A charging device 43 of the image forming unit 40 includes a charging roller 43*a*. The charging roller 43*a* contacts with the corresponding photosensitive drum 42, and rotates together with the photosensitive drum 42. In addition, a voltage for charging the photosensitive drum 42 is applied to the charging roller 43*a*. Then, the charging device 43 charges the surface of the photosensitive drum 42 at a uniform potential. Note that the charging device 43 may one that charges the photosensitive drum 42 using corona discharge, a brush, or the like.

The exposing device 41 disposed below the image forming units 40 emits laser beams toward the photosensitive drums 42. For instance, the exposing device 41 includes inside, optical system members such as a plurality of semiconductor laser devices (laser diodes), polygon mirrors, polygon motors, fθ lenses, mirrors (not shown), and the like. The exposing device 41 uses these optical system members so as to project light signals (laser beams, as illustrated by broken lines) based on an image signal decomposed for each color from image data to the charged photosensitive drum 42. In this way, the exposing device 41 performs scan and exposure so as to form an electrostatic latent image according to image data on the circumference surface of each photosensitive drum 42. Specifically, the photosensitive drum 42 of this embodiment is positively charged, and potential of a part exposed to light is lowered. The positively charged toner is adhered to the low potential part of the photosensitive drum 42. Note that it is possible to use other type of the exposing device 41 than the laser type, such as one using an array type LED.

The developing device 1 of the image forming unit 40 contains developer containing toner and magnetic carrier (so-called two-component developer). The image forming unit 40Bk contains black developer, the image forming unit 40Y contains yellow developer, the image forming unit 40C contains cyan developer, and the image forming unit 40M contains magenta developer. Note that the developing device 1 is connected to a container (not shown) for containing the toner. As the toner is consumed, the toner is added successively to the developing device 1.

The developing device 1 includes a developing roller 11, a magnetic roller 12, and a transport member 13. Further, the developing roller 11 is opposed to the corresponding photosensitive drum 42 so that axis lines thereof are parallel to each other. In addition, a gap (clearance) is formed between the developing roller 11 and the corresponding photosensitive drum 42. The gap has a predetermined width (for example, 1 mm or smaller).

When printing is performed, a thin layer of toner is formed on the circumference surface of the developing roller 11, and the developing roller 11 carries the toner to be charged. A voltage for letting the toner fly to the photosensitive drum 42 so as to develop the electrostatic latent image is applied to the developing roller 11 (see FIG. 4, and details will be described later).

The magnetic roller 12 of the developing device 1 is opposed to the corresponding developing roller 11, so that axis lines thereof are parallel to each other. A voltage is applied to the magnetic roller 12 for supplying toner to the developing roller 11, and for collecting or removing the toner (see FIG. 4 and others, and details will be described later).

The developing device 1 of this embodiment includes two transport members 13. The transport members 13 are disposed below the magnetic roller 12. For instance, the transport member 13 includes a helical blade, which stirs and transports the developer containing toner and carrier. By friction between the toner and the carrier along with this transportation, the toner is charged. The two transport members 13 have different rotation directions.

A roller shaft 11*a* of the developing roller 11 and a roller shaft 12*a* of the magnetic roller 12 are fixed and supported by a shaft support member (not shown) or the like. Further, a magnet 11*b* extending in the axial direction having a substantially rectangular cross section is attached to the roller shaft 11*a* of the developing roller 11. In addition, a magnet 12*b* extending in the axial direction having a substantially fan-shaped cross section is attached to the roller shaft 12*a* of the magnetic roller 12. In addition, the developing roller 11 and the magnetic roller 12 have cylindrical sleeves 11*c* and 12*c* that cover the magnet 11*b* and the magnet 12*b*, and are disposed not to contact with the magnet 11*b* and the magnet 12*b*, respectively. The sleeves 11*c* and 12*c* are rotated by a drive mechanism (not shown).

Further, the magnet 11*b* of the developing roller 11 and the magnet 12*b* of the magnetic roller 12 are opposed to each other with different poles at the opposing position of the developing roller 11 and the magnetic roller 12. Thus, a magnetic brush of the magnetic carrier is formed between the developing roller 11 and the magnetic roller 12. The toner is supplied to the developing roller 11 by rotation of the sleeve 12*c* of the magnetic roller 12 carrying the magnetic brush and voltage application to the magnetic roller 12, and hence a thin layer of toner is formed on the sleeve 11*c* of the developing roller 11. In addition, after the electrostatic latent image formed on the surface of the photosensitive drum 42 is developed with the toner, the magnetic brush tears off and collects the toner remaining on the surface of the developing roller 11.

A cleaning device 44 of the image forming unit 40 cleans the photosensitive drum 42. Each cleaning device 44 includes a blade 45 made of resin for example extending in the axial direction of the photosensitive drum 42 and a rubbing roller 46 that rubs the surface of the photosensitive drum 42 so as to remove the remaining toner and the like. The blade 45 and the rubbing roller 46 contact with the photosensitive drum 42 so as to scrape and remove dirty things such as residual toner and the like on the photosensitive drum 42. In addition, a charge neutralizer 47 (for example, an array type LED) for irradiating the photosensitive drum 42 with light so as to eliminate static electricity is disposed above the cleaning device 44.

Description is continued with reference to FIG. 1 again. The intermediate transfer portion 5 receives primary transfer of the toner image from the photosensitive drum 42 and performs secondary transfer onto the sheet. The intermediate transfer portion 5 includes a plurality of primary transfer rollers 51Bk to 51M, an intermediate transfer belt 52, a drive roller 53, follower rollers 54, 55, and 56, a secondary transfer roller 57, a belt cleaning device 58, and the like.

The intermediate transfer belt 52 is constituted of dielectric resin or the like and is stretched around the primary transfer rollers 51Bk to 51M, the drive roller 53, and the follower rollers 54 to 56. Then, when the drive roller 53 connected to a drive mechanism (not shown) such as a motor is driven to rotate, the intermediate transfer belt 52 rotates in the clockwise direction in the paper plane of FIG. 1. The primary transfer rollers 51Bk to 51M and the corresponding photosensitive drums 42 sandwich the endless intermediate transfer belt 52. A voltage for the primary transfer is applied to the primary transfer rollers 51Bk to 51M. The toner images (of black, yellow, cyan, and magenta colors) formed by the image forming units 40 are overlaid sequentially without misregistration and are transferred as the primary transfer onto the intermediate transfer belt 52.

In addition, the drive roller 53 and the secondary transfer roller 57 sandwich the intermediate transfer belt 52 and forms a secondary transfer nip. A predetermined voltage is applied to the secondary transfer roller 57. Then, the toner image on the intermediate transfer belt 52 constituted of the overlaid color images is transferred as the secondary transfer onto the sheet. Note that remaining toner and the like on the intermediate transfer belt 52 after the secondary transfer are removed by the belt cleaning device 58 and are collected.

The fixing portion 6 is disposed on the downstream side of the secondary transfer portion in the sheet transport direction. The fixing portion 6 includes a fixing roller 61 including a heat generating source and a pressure roller 62 pressing the fixing roller 61. The fixing portion 6 permits the sheet with the transferred toner image to pass through the nip between the fixing roller 61 and the pressure roller 62. When the sheet passes through the fixing nip, the toner image is heated and pressed, and as a result, the toner image is fixed to the sheet. The sheet after fixing is discharged onto the discharge tray 31, and hence printing of one paper sheet is finished.

(Hardware Structure of Printer 100)

Figure 3:
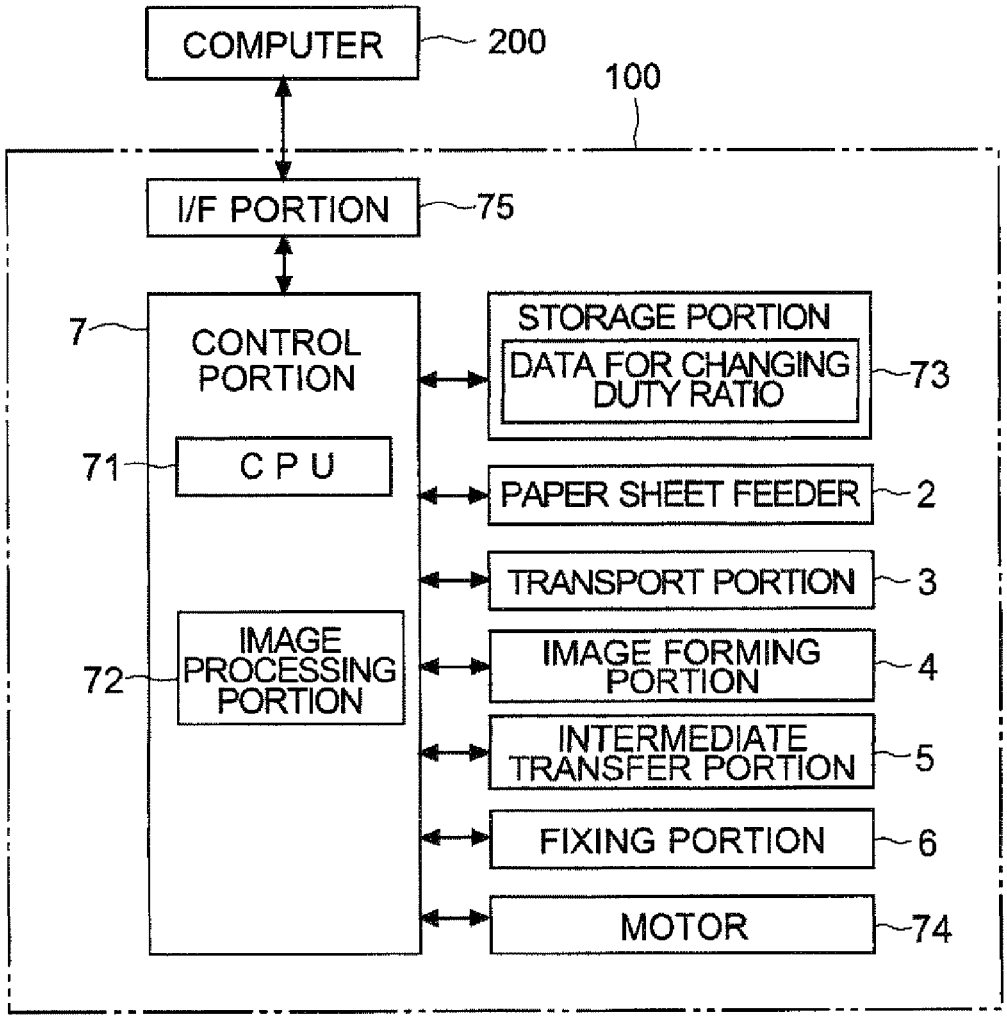
FIG. 3 is a block diagram illustrating an example of a hardware structure of the printer.

Next, with reference to FIG. 3, a hardware structure of the printer 100 according to the embodiment is described. FIG. 3 is a block diagram illustrating an example of a hardware structure of the printer 100.

As illustrated in FIG. 3, the printer 100 according to this embodiment includes a control portion 7. The control portion 7 controls individual portions of the apparatus. For instance, the control portion 7 includes a circuits and elements for performing processes, such as a CPU 71, an image processing portion 72, and the like. In addition, the printer 100 includes a storage portion 73. For instance, the storage portion 73 is a combination of nonvolatile and volatile storage devices such as a ROM, a RAM, a flash ROM, and the like. Note that this embodiment describes an example in which the control portion 7 performs print control, but the controlling portion (substrate) may be divided into a plurality of types in accordance with functions and roles, such as an engine control portion for controlling a printing portion and a main control portion for performing general control and image processing.

The CPU 71 performs control and operation of individual portions of the printer 100 based on a control program that is stored in the storage portion 73 and is expanded. For instance, the storage portion 73 can store, in addition to the control program for the printer 100, various data such as control data. Further, the storage portion 73 also stores a program and data related to voltage application setting for the developing roller 11 and the magnetic roller 12, such as a duty ratio of voltage application to the developing roller 11 and the magnetic roller 12, and a set value of a DC bias voltage.

Further, the control portion 7 is connected to the paper sheet feeder 2, the transport portion 3, the image forming portion 4, the intermediate transfer portion 5, the fixing portion 6, and the like, so as to control actions of the individual portions so that image formation can be performed appropriately based on the control program and data stored in the storage portion 73. In addition, the control portion 7 controls one or more motors 74 disposed in the printer 100. The control portion 7 controls the motor 74 to rotate and drive the various rotating member such as the photosensitive drum 42, the developing roller 11, and the magnetic roller 12 to rotate. Utilizing the drive of this motor 74, the sleeves 11*c* and 12*c* of the developing roller 11 and the magnetic roller 12 rotate.

In addition, the control portion 7 is connected to a computer 200 (a personal computer or a server) via an I/F portion 75 (interface portion). The computer 200 transmits print data for the printer 100 to perform printing. The print data includes print setting data, image data, and the like. Based on the received print data, the control portion 7 controls the image processing portion 72 to perform image processing so as to generate image data for the exposing device 41. The exposing device 41 receives the image data and forms the electrostatic latent image on the photosensitive drum 42.

(Voltage Application in Developing Device 1)

Figure 4:
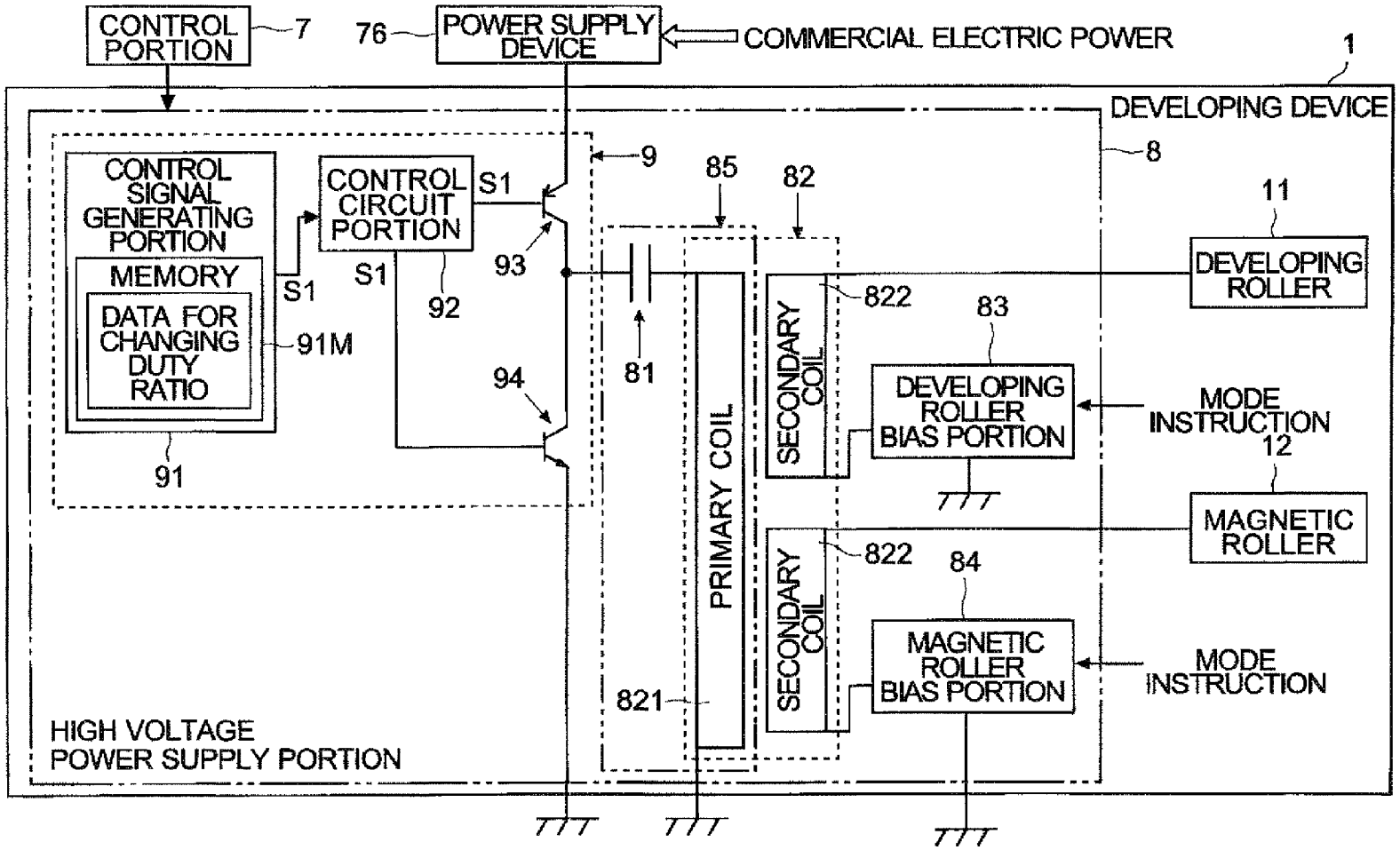
FIG. 4 is a block diagram illustrating an example of a developing device.
Figure 5:
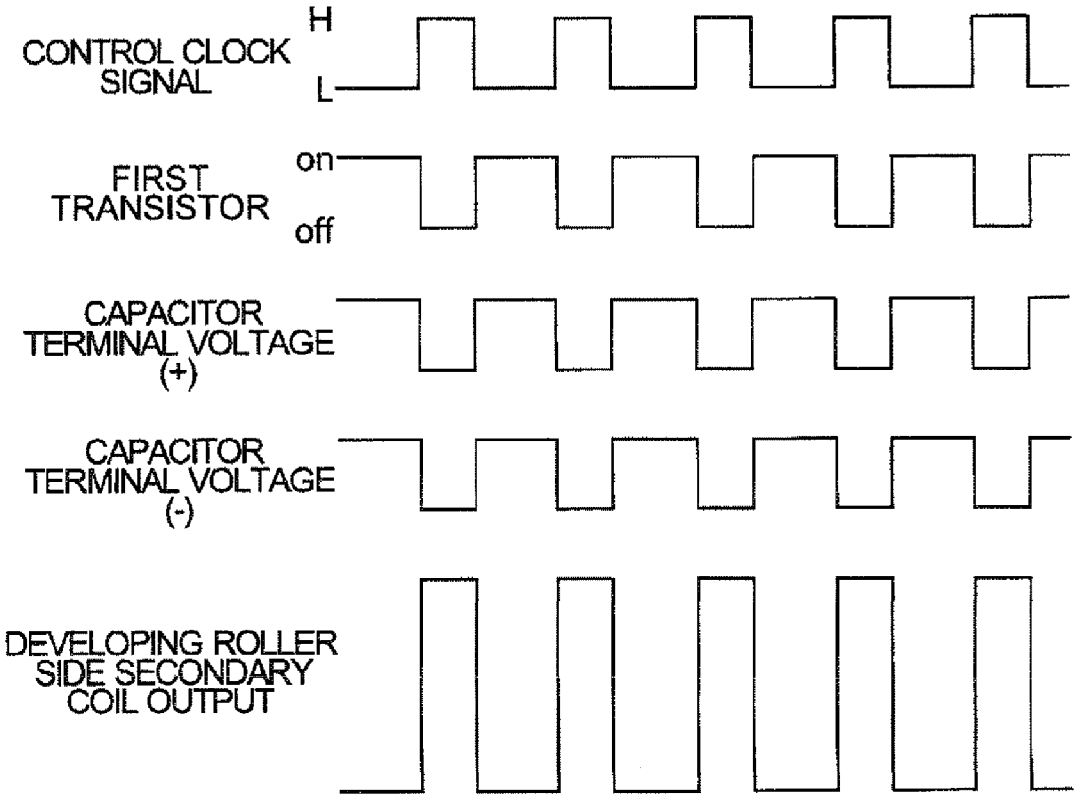
FIG. 5 is a timing chart illustrating an example of voltage waveforms in a high voltage power supply portion.

Next, with reference to FIGS. 4 and 5, an example of voltage application in the developing device 1 is described. FIG. 4 is a block diagram illustrating an example of the developing device 1. FIG. 5 is a timing chart illustrating an example of waveforms of voltages in a high voltage power supply portion 8 of the developing device 1.

As described above, the developing device 1 of this embodiment is equipped with the developing roller 11 and the magnetic roller 12. Voltages are applied to the developing roller 11 and the magnetic roller 12 for developing the electrostatic latent image with toner, for supplying toner from the magnetic roller 12 to the developing roller 11, and for removing the toner from the developing roller 11. In other words, in order to move the toner appropriately, voltages are applied to the developing roller 11 and the magnetic roller 12.

The developing device 1 includes the high voltage power supply portion 8 for applying voltages to the developing roller 11 and the magnetic roller 12. The high voltage power supply portion 8 steps up an input voltage and applies (outputs) the obtained voltage to the developing roller 11 and the magnetic roller 12.

For instance, the high voltage power supply portion 8 of this embodiment includes a capacitor 81, a transformer 82, a switching portion 9, a developing roller bias portion 83, and a magnetic roller bias portion 84. The developing devices 1 have different timings for starting developing and different timings for finishing the same. Therefore, the high voltage power supply portion 8 is disposed for each developing device 1 (for one combination of the developing roller 11 and the magnetic roller 12).

For instance, an electrolytic capacitor is used as the capacitor 81. One of electrodes of the capacitor 81 is connected to the switching portion 9. In addition, the other electrode of the capacitor 81 is connected to a primary coil 821 of the transformer 82. In this way, the capacitor 81 and the transformer 82 are connected to each other as a serial circuit 85 (in FIG. 4, the serial circuit 85 of the capacitor 81 and the transformer 82 is enclosed by a triple-dot-dashed line). The capacitor 81 removes a DC component from the signal (voltage) output from the switching portion 9 and supplies the obtained signal to the primary coil 821 of the transformer 82.

For instance, the switching portion 9 includes a control signal generating portion 91, a control circuit portion 92, a first transistor 93 (corresponding to the switching element), and a second transistor 94. The control signal generating portion 91 outputs a control clock signal S1 (corresponding to the control signal) for controlling the duty ratio or the like of the alternating voltage to be applied to the developing roller 11. The control signal generating portion 91 changes the duty ratio of the control clock signal S1 based on an instruction of the control portion 7 in accordance with a mode of the printer 100 and execution or inexecution of developing. Although details will be described later, an alternating voltage having the same duty ratio as the control clock signal S1 output from the control signal generating portion 91 is applied to the developing roller 11.

The control circuit portion 92 applies the control clock signal S1 whose voltage value and the like are adjusted in accordance with each transistor to the first transistor 93 and the second transistor 94 (frequency of the control clock signal S1 can be approximately a few kHz, e.g., approximately 3 to 5 kHz). Further, the first transistor 93 is a pnp transistor. The first transistor 93 is turned off when the control clock signal S1 is High, and is turned on when the signal is Low.

Further, an emitter of the first transistor 93 is connected to a power supply device 76. The power supply device 76 is disposed inside the printer 100 and is supplied with commercial electric power. The power supply device 76 performs rectifying, smoothing, and the like so as to output a DC voltage. For instance, the power supply device 76 outputs DC 24 V, which is applied to the first transistor 93. In addition, a base of the first transistor 93 is connected to the control circuit portion 92. In addition, a collector of the first transistor 93 is connected to a second transistor 94 and the capacitor 81.

The second transistor 94 is an npn transistor. A base of the second transistor 94 is connected to the control circuit portion 92, a collector of the same is connected to the collector of the first transistor 93 and the capacitor 81, and an emitter of the same is connected to the ground. The second transistor 94 is turned on when the control clock signal S1 is High and is turned off when the signal is Low. Therefore, when the first transistor 93 is turned on, the second transistor 94 is turned off. When the first transistor 93 is turned off, the second transistor 94 is turned on.

Here, the first transistor 93 is a pnp type, and the capacitor 81 is connected to the collector of the first transistor 93. Therefore, a voltage of inverted logic of the control clock signal S1 is applied to the capacitor 81. In other words, a signal after inverting the logic of the control clock signal S1 and amplifying the same is applied to the collector of the first transistor 93. The voltage applied to the capacitor 81 has the same frequency as the control clock signal S1, and a duty ratio thereof is "1−(duty ratio of the control clock signal S1)". Therefore, there is a relationship that the duty ratio of the voltage applied to the capacitor 81 plus the duty ratio of the control clock signal S1 is one. For instance, if the duty ratio of the control clock signal S1 is 10%, the duty ratio of the voltage applied to the capacitor 81 is 90%.

The capacitor 81 is connected to the collector of the first transistor 93. In addition, the capacitor 81 is connected to the primary (primary coil 821) of the transformer 82. The capacitor 81 removes a DC component from the voltage applied by ON/OFF of the first transistor 93 and supplies the obtained signal (voltage) to the transformer 82. In other words, an AC waveform is supplied to the transformer 82.

The transformer 82 steps up the voltage supplied to the primary and outputs the obtained voltage. Further, the secondary has at least two outputs, one of which is connected to the developing roller 11, while the other is connected to the magnetic roller 12. Note that a step-up factor may be different between the outputs. In addition, the developing roller bias portion 83 for biasing the alternating voltage applied to the developing roller 11 is disposed to the output on the developing roller 11 side. Similarly, in addition, the magnetic roller bias portion 84 for biasing the alternating voltage applied to the magnetic roller 12 is disposed to the output on the magnetic roller 12 side. The alternating voltage biased with DC voltage by the developing roller bias portion 83 is applied to the developing roller 11. In addition, the alternating voltage biased with the DC voltage by the magnetic roller bias portion 84 is applied to the magnetic roller 12.

For instance, the developing roller bias portion 83 and the magnetic roller bias portion 84 are converters that step up the output voltage from the power supply device 76. Further, the developing roller bias portion 83 and the magnetic roller bias portion 84 are circuit that can change the output. In other words, the developing roller bias portion 83 and the magnetic roller bias portion 84 can change voltage values for the biasing.

Here, with reference to FIG. 5, an example of voltage waveforms in the high voltage power supply portion 8 of the developing device 1 is described. A chart on the uppermost part in FIG. 5 illustrates the control clock signal S1. Note that ON/OFF of the second transistor 94 is the same as the chart on the uppermost part. Further, a second chart in FIG. 5 illustrates ON/OFF of the first transistor 93. As illustrated in FIG. 5, ON/OFF timing of the first transistor 93 and the control clock signal S1 are opposite to each other in logic. A third chart in FIG. 5 illustrates a voltage transition of a positive electrode of the capacitor 81. A fourth chart in FIG. 5 illustrates a voltage transition of a negative electrode of the capacitor 81. As illustrated in the third and fourth charts, the output voltage of the power supply device 76 is applied to the capacitor 81 when the first transistor 93 is turned on. Further, when the first transistor 93 is turned off, the second transistor 94 is turned on so that the capacitor 81 discharges. In addition, in this embodiment, when the control clock signal S1 is generated, the capacitor 81 stores charge corresponding to the duty ratio of the control clock signal S1.

In addition, a chart on the lowest part in FIG. 5 is an example of an output waveform of a secondary coil 822 on the developing roller 11 side. As illustrated in FIG. 5, the transformer 82 of this embodiment is a type that outputs a waveform of an opposite logic to the voltage applied to the capacitor 81 (inverted output). In other words, the secondary coil outputs the waveform having High and Low levels opposite to the voltage applied to the capacitor 81. Therefore, the alternating voltage waveform applied to the developing roller 11 and the control clock signal S1 have the same waveform, and the alternating voltage applied to the developing roller 11 has the same duty ratio as the control clock signal S1.

(Voltage Application Mode in Developing Device 1)

Figure 6:
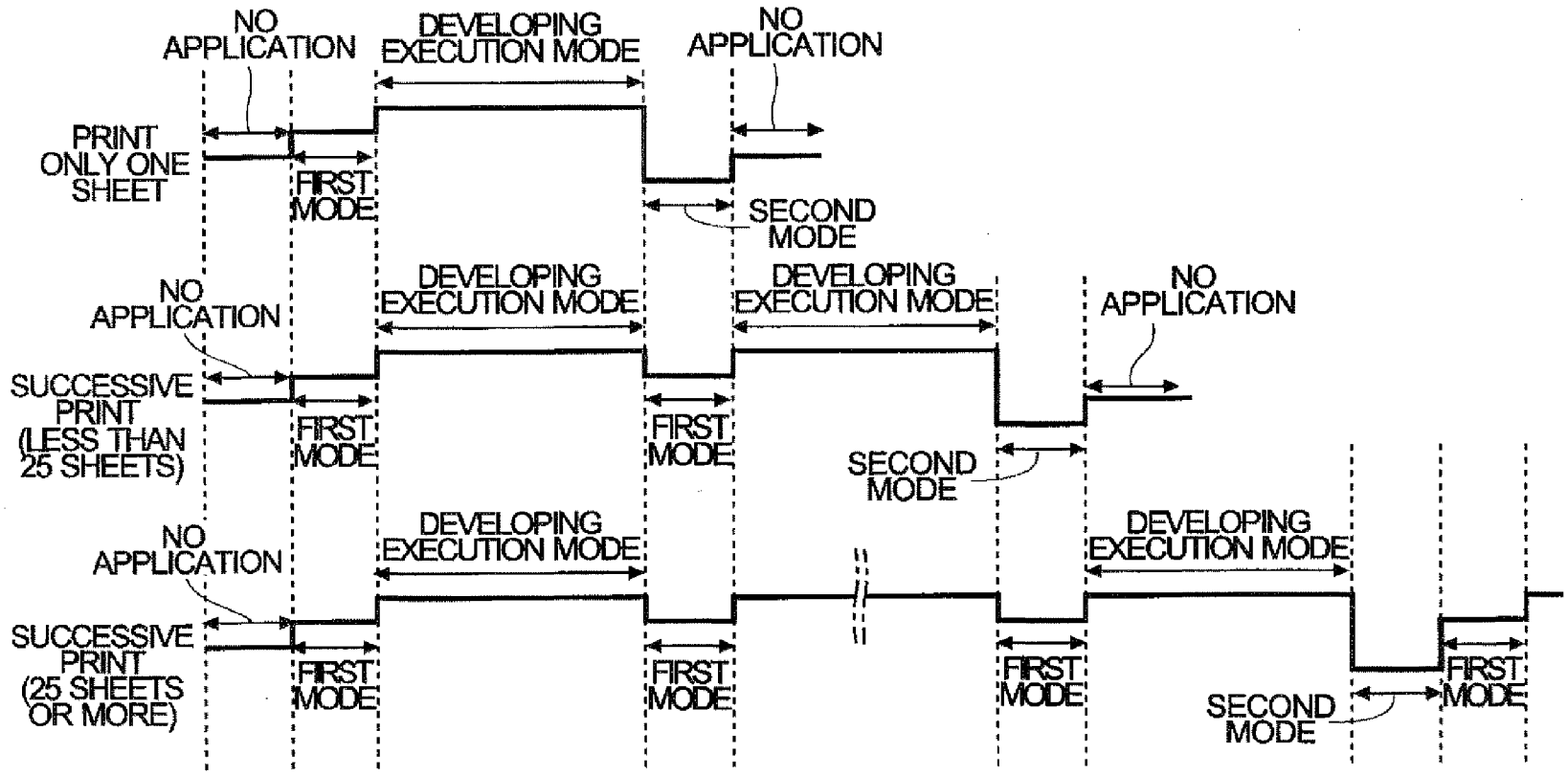
FIG. 6 is an explanatory diagram illustrating an example of voltage application mode transition.

Next, with reference to FIG. 6, a voltage application mode in the developing device 1 of this embodiment is described. FIG. 6 is an explanatory diagram illustrating an example of a voltage application mode transition.

The developing device 1 of this embodiment has a developing execution mode in which the developing of an electrostatic latent image with toner is performed, and a developing inexecution mode in which the developing of an electrostatic latent image is not performed. In addition, the developing inexecution mode includes a first mode and a second mode. The high voltage power supply portion 8 of the developing device 1 changes DC voltage values to be applied to the developing roller 11 and the magnetic roller 12, and the duty ratio of the control clock signal S1 (duty ratio of the voltage applied to the capacitor 81) in accordance with the mode. Note that it is not necessary to apply voltages to the developing roller 11 and the magnetic roller 12 when printing is not performed, and hence states (modes) of the developing device 1 includes, in addition to the above-mentioned three modes (the developing execution mode, the first mode, and the second mode), a non-application state in which voltages are not applied to the developing roller 11 and the magnetic roller 12.

The developing execution mode is a mode in which the toner flies so that the electrostatic latent image on the photosensitive drum 42 is developed. The first mode (one type of a developing unexecuted mode) is a mode before changing to the developing execution mode. In this mode, the toner is supplied to the developing roller 11 for adjusting the thin layer of toner on the surface of the developing roller 11 (sleeve 11*c*). The second mode (one type of the developing unexecuted mode) is a mode in which the toner is taken off from the surface of the developing roller 11 and is collected. In this mode, the toner on the surface of the developing roller 11 is exchanged so that adhesion of the toner onto the developing roller 11 is prevented.

First, in the developing execution mode, an alternating voltage having a predetermined peak-to-peak voltage is applied to the developing roller 11. In addition, in the developing execution mode, in order to supply toner to the developing roller 11, the developing roller bias portion 83 and the magnetic roller bias portion 84 output DC voltages so that the output voltage value of the developing roller bias portion 83 becomes smaller than the output voltage value of the magnetic roller bias portion 84. In other words, the output voltage of the magnetic roller bias portion 84 is set larger than the output voltage of the developing roller bias portion 83, so that the positively charged toner can easily move in the direction from the magnetic roller 12 to the developing roller 11.

The first mode is a mode for forming a thin layer of toner on the circumference surface of the developing roller 11 before printing. Therefore, it is necessary to apply a bias so that the charged toner moves from the magnetic roller 12 to the developing roller 11. Therefore, similarly to the developing execution mode, the developing roller bias portion 83 and the magnetic roller bias portion 84 output DC voltages so that the output voltage value of the developing roller bias portion 83 becomes smaller than the output voltage value of the magnetic roller bias portion 84. In addition, in the first mode, it is possible to apply an alternating voltage having a predetermined peak-to-peak voltage to the developing roller 11.

In addition, the second mode is a mode in which the toner is taken off from the circumference surface of the developing roller 11, and the toner is collected on the magnetic roller 12 side. Therefore, it is necessary to apply a bias so that the toner can easily move from the developing roller 11 toward the magnetic roller 12. Therefore, in the second mode, the developing roller bias portion 83 and the magnetic roller bias portion 84 output DC voltages so that the output voltage value of the developing roller bias portion 83 becomes larger than the output voltage value of the magnetic roller bias portion 84. In this way, the positively charged toner moves in the direction from the developing roller 11 to the magnetic roller 12. In addition, also in the second mode, an alternating voltage having a predetermined peak-to-peak voltage may be applied to the developing roller 11.

Note that the mode is changed to other mode when a time for the developing roller 11 to rotate one turn or longer time has passed after becoming the first mode or the second mode. In other words, the first mode or the second mode continues for a time period necessary for the developing roller 11 to rotate at least one turn.

For instance, the control portion 7 receives a signal indicating the mode to the developing roller bias portion 83 and the magnetic roller bias portion 84 in accordance with a state of the printer 100. The developing roller bias portion 83 and the magnetic roller bias portion 84 change output voltage values in accordance with the indicated mode.

Further, FIG. 6 illustrates three example of mode transition. First, the uppermost part in FIG. 6 illustrates a state transition when only one sheet is printed. When only one sheet is printed, the control portion 7 controls the high voltage power supply portion 8 so that the developing device 1 becomes the first mode from the non-application state before starting the developing, and hence the thin layer of toner is formed on the surface of the developing roller 11 (sleeve 11*c*). After that, the control portion 7 controls the high voltage power supply portion 8 so that the developing device 1 becomes the developing execution mode, and hence toner supply from the magnetic roller 12 to the developing roller 11 is continued. Then, when developing is completed (printing is completed), the control portion 7 controls the high voltage power supply portion 8 so that the developing device 1 becomes the second mode, and the toner is collected from the developing roller 11. After that, the developing device 1 becomes the non-application state.

Next, the middle part in FIG. 6 illustrates a state transition when a plurality of pages less than 25 pages are printed continuously. The process until starting the developing is the same as in the case where only one sheet is printed. Then, when the developing of a toner image corresponding to a first page is started, the control portion 7 controls the high voltage power supply portion 8 so as to be the developing execution mode during the developing process, and the developing device 1 is set to be the first mode between paper sheets. Therefore, the first mode and the developing execution mode are repeated. Then, when the developing (printing) process is completed in the job, the control portion 7 controls the high voltage power supply portion 8 so that the developing device 1 becomes the second mode. After that, the developing device 1 becomes the non-application state.

Next, a lowermost part in FIG. 6 illustrates a state transition when a plurality of pages that are 25 pages or more are printed continuously. The process until starting the developing is the same as in the case where only one sheet is printed. Then, when the developing of a toner image corresponding to a first page is started, the control portion 7 generally controls the high voltage power supply portion 8 so as to be the developing execution mode during the developing process, and the developing device 1 is set to be the first mode between paper sheets. Therefore, the first mode and the developing execution mode are repeated. Then, when 25 sheets are printed, the control portion 7 controls the high voltage power supply portion 8 so that the developing device 1 becomes the second mode, and the toner on the circumference surface of the developing roller 11 is refreshed. Note that the second mode is performed every time when 25 sheets are printed.

After the second mode, the control portion 7 controls again the high voltage power supply portion 8 so that the developing device 1 becomes the first mode, and the developing process is restarted (changes to the developing execution mode). When the developing (printing) process is completed, the control portion 7 controls the high voltage power supply portion 8 so that the developing device 1 becomes the second mode. After that, the developing device 1 becomes the non-application state. Note that 25 sheets are reference for performing the second mode in this description, but without limiting to 25 sheets, the reference may be 26 sheets or more, or may be 24 sheets or less.

(Duty Ratio in Each Mode)

Figure 7:
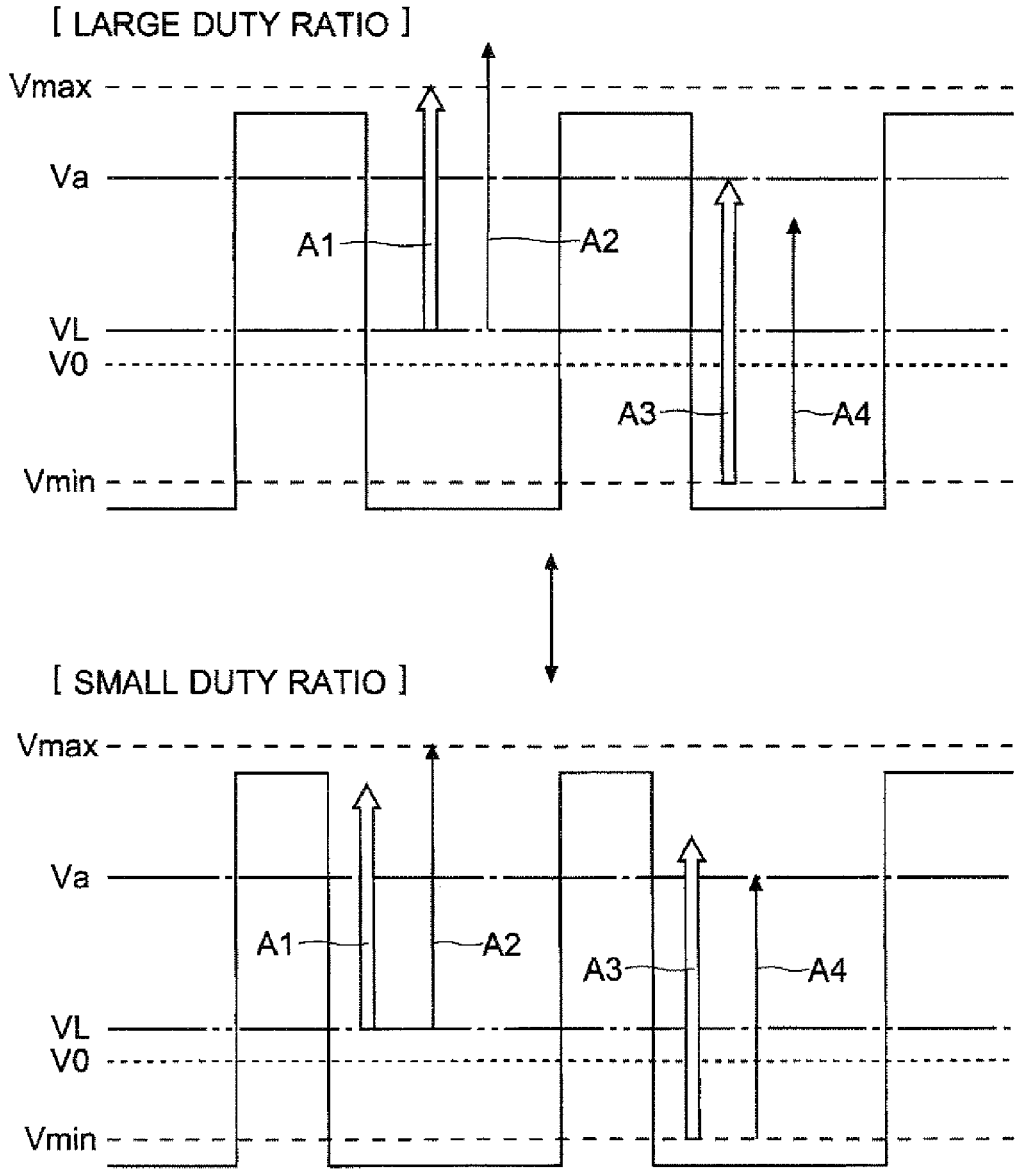
FIG. 7 is an explanatory diagram for describing influence of a duty ratio difference of voltage applied to the developing roller.

Next, with reference to FIG. 7, the change of the duty ratio and the voltage application mode in the developing device 1 of this embodiment is described. FIG. 7 is an explanatory diagram for describing an influence of a duty ratio difference of the voltage applied to the developing roller 11.

By changing the duty ratio of the control clock signal S1, the duty ratio of the alternating voltage applied to the developing roller 11 and the duty ratio of the voltage applied to the capacitor 81 are changed. Specifically, the control signal generating portion 91 changes the duty ratio of the control clock signal 51 (duty ratio of switching of the first transistor 93) in accordance with the mode of the developing device 1. Then, the control signal generating portion 91 increases the duty ratio of the control clock signal 51 (voltage applied to the developing roller 11) in the developing execution mode than in the first mode and in the second mode. In this case, because output is inverted, the duty ratio of the voltage applied to the capacitor 81 is decreased.

First, with reference to FIG. 7, there is described that the toner flies differently depending on the duty ratio. FIG. 7 illustrates an example of a voltage waveform applied to the developing roller 11. In FIG. 7, the duty ratio (approximately 40%) of the voltage applied to the developing roller 11 illustrated in the upper timing chart is larger than the duty ratio (approximately 30%) of the voltage applied to the developing roller 11 illustrated in the lower timing chart.

First, the solid line in each timing chart of FIG. 7 illustrates a waveform indicating a voltage variation applied to the developing roller 11. Therefore, the vertical axis in each timing chart indicates a voltage amplitude. The peak-to-peak voltage in this waveform is set in the range of 1 to 2 kV. Further, a V0 line (illustrated by a broken line) in FIG. 7 indicates 0 V (ground).

The capacitor 81 removes a DC component. Therefore, in the peak-to-peak voltage of the waveform indicating the voltage variation applied to the developing roller 11, a position of the V0 line becomes a position where the product of a High time period and the amplitude is equal to the product of a Low time period and the amplitude in one period (area center). For instance, when the duty ratio is 40% and the peak-to-peak voltage is 1000 V in a rectangular wave, a potential difference between the V0 line and a positive peak is 600 V, while a potential difference between the V0 line and a negative peak is 400 V.

In addition, a VL line (illustrated by a double-dot-dashed line) in each timing chart of FIG. 7 indicates a potential of the photosensitive drum 42 after the exposing process (for example, approximately 100 to 200 V). In addition, a Va line (illustrated by a dashed dotted line) in each timing chart of FIG. 7 indicates a potential of the photosensitive drum 42 in the charged state (for example, approximately 400 to 600 V). Further, a Vmax line (upper line illustrated by a wide interval broken line) in each timing chart of FIG. 7 indicates a positive peak value of the voltage applied to the developing roller 11 when being biased by the developing roller bias portion 83. A Vmin line (lower line illustrated by a wide interval broken line) in each timing chart of FIG. 7 indicates a negative peak value of the voltage applied to the developing roller 11 when being biased by the developing roller bias portion 83.

In the developing process, the positively charged toner flies from the developing roller 11 to the photosensitive drum 42 at an exposed portion. Therefore, as a potential difference between the potential (VL) of the exposed photosensitive drum 42 and Vmax is larger, an electrostatic force acting on the toner becomes larger so that the toner moves faster.

Here, as illustrated in FIG. 7, based on the concept of area center, the difference (indicated by a solid line arrow A2 in FIG. 7) between the potential (VL) of the photoconductor drum 42 and the potential at Vmax after the exposure when the duty ratio is small is larger than the difference (indicated by a white-colored arrow A1 in FIG. 7) between the potential (VL) of the photoconductor drum 42 and the potential at Vmax after the exposure when the duty ratio is large. Therefore, as the duty ratio is smaller, the toner can quickly fly so that the toner can be quickly adhered to exposed dots. Therefore, it is said that as the duty ratio is smaller, reproducibility of one dot becomes higher.

However, it is experimentally known that as the duty ratio of the voltage applied to the developing roller 11 is smaller, unevenness appears more easily in the developed toner image. For instance, when a solid image having a uniform density is printed, as the duty ratio of the voltage applied to the developing roller 11 is smaller, unevenness of density appears more easily in the printed result (which may be referred to as "developing drive unevenness"). Although a mechanism of generating the developing drive unevenness is not completely elucidated, the developing roller 11 and the photosensitive drum 42 have manufacturing errors and attachment errors, and a width of a gap between the photosensitive drum 42 and the developing roller 11 is not the same in all positions in the axial direction. In addition, the width of the gap varies along with rotation. Further, it is considered that as the reproducibility of one dot becomes higher, a fluctuation of the gap causes larger unevenness.

On the other hand, it is experimentally known that when the duty ratio of the voltage applied to the developing roller 11 is increased, a leakage (discharge) is apt to occur. The gap between the photosensitive drum 42 and the developing roller 11 is very small (1 mm or small). As a potential difference between the photosensitive drum 42 and the developing roller 11 becomes larger, a leakage occurs more easily.

Here, in the developing device 1 of this embodiment, when the voltage applied to the developing roller 11 becomes small, the leakage is apt to occur. Further, as the negative peak voltage applied to the developing roller 11 is smaller (larger in the negative direction), the leakage is apt to occur. Note that as the voltage applied to the developing roller 11 is larger, the leakage may occur more easily, because of charging characteristics of the toner or charging characteristics of the photosensitive drum 42.

Then, as illustrated in FIG. 7, based on the concept of area center, a potential difference between a potential (Va) of the charged photosensitive drum 42 when the duty ratio of the voltage applied to the developing roller 11 is large and a potential (Vmin) when the voltage applied to the developing roller 11 is at a negative peak (illustrated by a hollow arrow A3 in FIG. 7) is larger than a potential difference between the potential (Va) of the charged photosensitive drum 42 when the duty ratio is small and the potential (Vmin) when the voltage applied to the developing roller 11 is at the negative peak (illustrated by a solid line arrow A4 in FIG. 7). In other words, as the duty ratio of the voltage applied to the developing roller 11 is larger, the leakage (discharge) occurs more easily in the developing device 1 of this embodiment.

When the leakage occurs, potential of the photosensitive drum 42 may be lowered so that the toner is adhered to the same. When the toner is adhered to the photosensitive drum 42 in a period other than the developing execution period, the intermediate transfer belt 52 or the secondary transfer roller 57 may be dirty with the toner. Thus, the toner may adhere to the paper sheet so that the paper sheet may become dirty. In addition, if the current in the leakage is large, a very small hole may be formed in the photosensitive drum 42 so that image quality of a toner image formed afterward may be deteriorated.

Therefore, in the printer 100 of this embodiment, the high voltage power supply portion 8 (control signal generating portion 91) sets the duty ratio of the voltage to be applied to the developing roller 11 to be larger (sets the duty ratio of the control clock signal S1 to be larger) in the developing execution mode than in the first mode or in the second mode, in order to suppress unevenness of the toner image so that image quality is improved. On the other hand, the high voltage power supply portion 8 (control signal generating portion 91) sets the duty ratio of the voltage applied to the developing roller 11 to be smaller (sets the duty ratio of the control clock signal S1 to be smaller) in the first mode and in the second mode than in the developing execution mode, in order to prevent occurrence of leakage. In this way, duty ratios in the developing execution mode, the first mode, and the second mode are determined in advance.

For instance, the control portion 7 indicates the mode of the developing device 1 to the control signal generating portion 91 in accordance with a printing step, a state of the printer 100, and the number of copies to be printed. For instance, when the exposing device 41 starts the exposure, the control portion 7 instructs the control signal generating portion 91 to change to the developing execution mode. In addition, when the exposing device 41 finishes the exposure, the control portion 7 instructs the control signal generating portion 91 to change to the first mode or the second mode. The control signal generating portion 91 changes the duty ratio in accordance with the mode indication by the control portion 7. Otherwise, the control portion 7 may give a signal indicating the duty ratio itself to the control signal generating portion 91, and the control signal generating portion 91 may change the duty ratio in accordance with the instruction.

(Change of Duty Ratio Step by Step)

Figure 8:
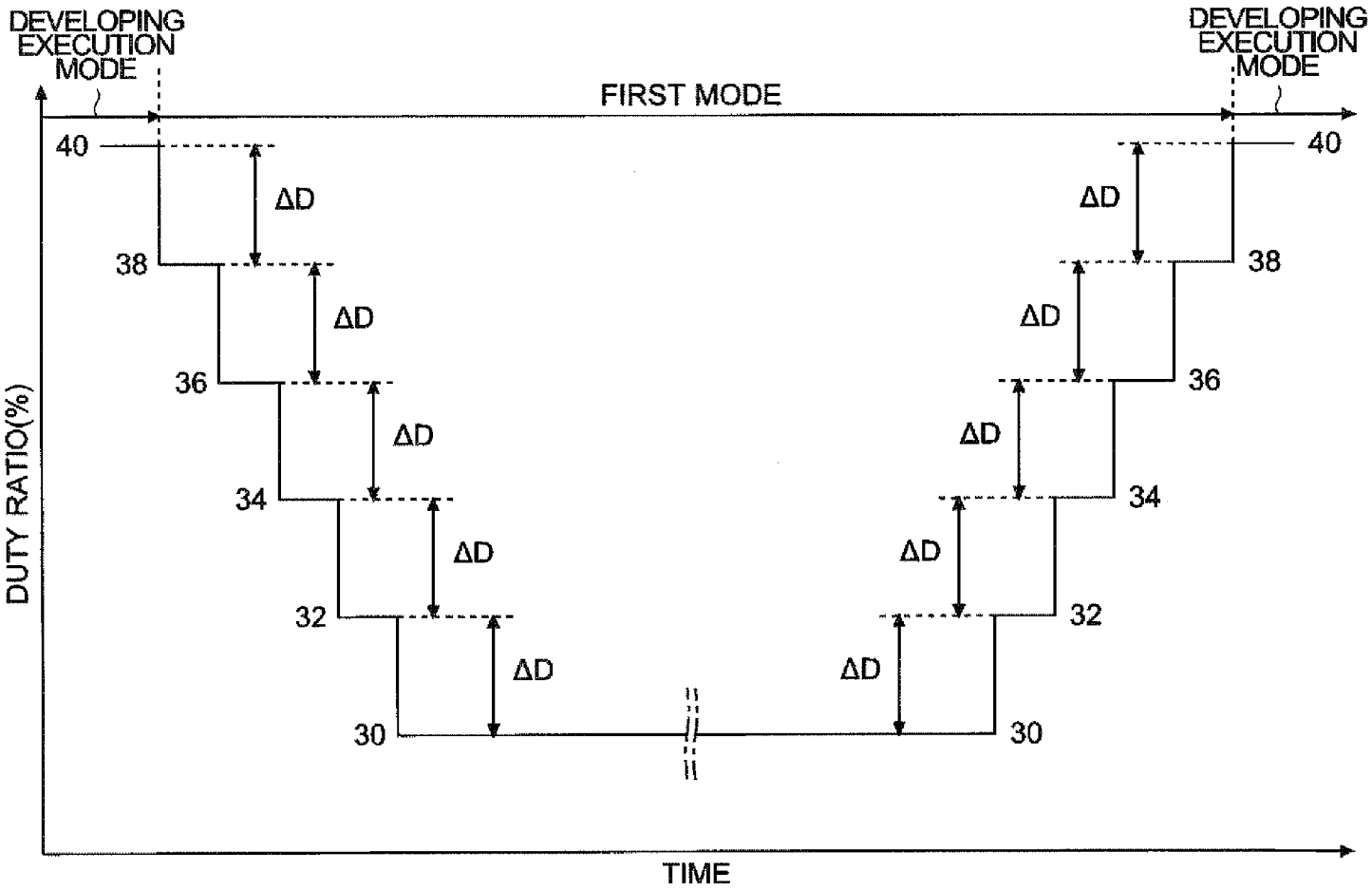
FIG. 8 is an explanatory diagram illustrating an outline of a step by step change of the duty ratio.

Next, with reference to FIG. 8, a step-by-step change of the duty ratio in this embodiment is described. FIG. 8 is an explanatory diagram illustrating an outline of the step-by-step change of the duty ratio.

The printer 100 of this embodiment changes the duty ratio in accordance with the mode. In the developing execution mode, the control signal generating portion 91 sets the duty ratio of the control clock signal S1 and the duty ratio of the voltage applied to the developing roller 11 to be approximately 40% (the duty ratio of the voltage applied to the capacitor 81 is approximately 60%). On the other hand, in the first mode or the second mode between sheets, before execution of developing, or after completion of developing, the control signal generating portion 91 sets the duty ratio of the control clock signal S1 and the duty ratio of the voltage applied to the developing roller 11 to be approximately 30% (the duty ratio of the voltage applied to the capacitor 81 is approximately 70%). Note that the duty ratio is the same between the first mode and the second mode in the description of this embodiment, but they may be different.

However, when the transformer 82 (coil) is used, the change of the duty ratio causes application of a voltage asymmetric in positive and negative to the transformer 82. When the voltage asymmetric in positive and negative is applied to the transformer 82, asymmetric magnetization occurs in the transformer 82 resulting in such a state that a DC bias is applied.

In particular, if an alternating voltage is applied to the transformer 82 in the state where the asymmetric magnetization is generated, magnetic saturation is apt to occur. When the magnetic saturation occurs, impedance of the transformer 82 usually becomes only a resistance component of the coil. Then, large current may flow in the first transistor 93 (primary) connected to the transformer 82 via the capacitor 81 so that the first transistor 93 may be broken down.

As a variation amount of the duty ratio is larger, asymmetric magnetization degree in the transformer 82 becomes larger. In the state where the asymmetric magnetization degree is large, magnetic saturation is easily generated. In the developing device 1 of this embodiment, the duty ratio is different between the developing execution mode and the first mode or the second mode by approximately 10%. Then, if the duty ratio is changed by 10% at a burst, the asymmetric magnetization degree becomes large so that the first transistor 93 may be broken down with high probability.

On the other hand, if the asymmetric magnetization is generated by the change of the duty ratio, the transformer 82 becomes a state of being biased so that a potential between the capacitor 81 and the transformer 82 changes. Then, because of resonance between the capacitor 81 and the transformer 82, the potential between the capacitor 81 and the transformer 82 is oscillating while the asymmetric magnetization is being decreased as time passes. Therefore, the asymmetric magnetization of the transformer 82 is apt to be decreased as time passes.

Therefore, in the developing device 1 of this embodiment, the control signal generating portion 91 changes the duty ratio of the control clock signal S1 (voltage applied to the capacitor 81) step by step, and hence the variation amount of the duty ratio per one time is suppressed. Then, the control signal generating portion 91 changes the duty ratio to a target value. In this way, it is possible to change the duty ratio without breaking down the first transistor 93 due to overcurrent.

Therefore, an example of the duty ratio change is described with reference to FIG. 8. FIG. 8 illustrates an example of the duty ratio change in which paper sheets are printed successively, and the mode is changed from the developing execution mode to the first mode between sheets, and to the developing execution mode. Note that in the example of FIG. 8, the duty ratio of the control clock signal S1 in the developing execution mode is set to approximately 40% (the duty ratio of the voltage applied to the capacitor 81 is approximately 60%), and the duty ratio of the control clock signal S1 in the first mode is set to approximately 30% (the duty ratio of the voltage applied to the capacitor 81 is approximately 70%). Note that the duty ratio is not limited to the example described above.

As illustrated in FIG. 8, when the duty ratio of the control clock signal S1 is changed from the duty ratio in the developing execution mode to the duty ratio in the first mode, the control signal generating portion 91 changes the duty ratio by a step such that magnetic saturation does not occur in the transformer 82 (an example of the step is illustrated by ΔD in FIG. 8). In addition, also when the duty ratio of the control clock signal S1 in the first mode is changed back to the duty ratio of the control clock signal S1 in the developing execution mode, the control signal generating portion 91 changes the duty ratio by a step (increment, decrement) such that magnetic saturation does not occur in the transformer 82 (an example of the step is illustrated by ΔD in FIG. 8). For instance, in the example of in the example of FIG. 8, the step is 2%. This step can be arbitrarily set to a value such that magnetic saturation does not occur in the transformer 82, by performing an experiment in advance.

As illustrated in FIG. 8, if a width of the duty ratio of the control clock signal S1 to be changed is 10% and the step is 2%, the control signal generating portion 91 changes the duty ratio by five steps (by changing five times). The number of steps may be six or larger, or may be two to four. As the number of steps is larger, it is harder for magnetic saturation to occur in the transformer 82. Therefore, it is preferred to adopt five or larger steps, for example.

(Timing to Change Duty Ratio)

Figure 9:
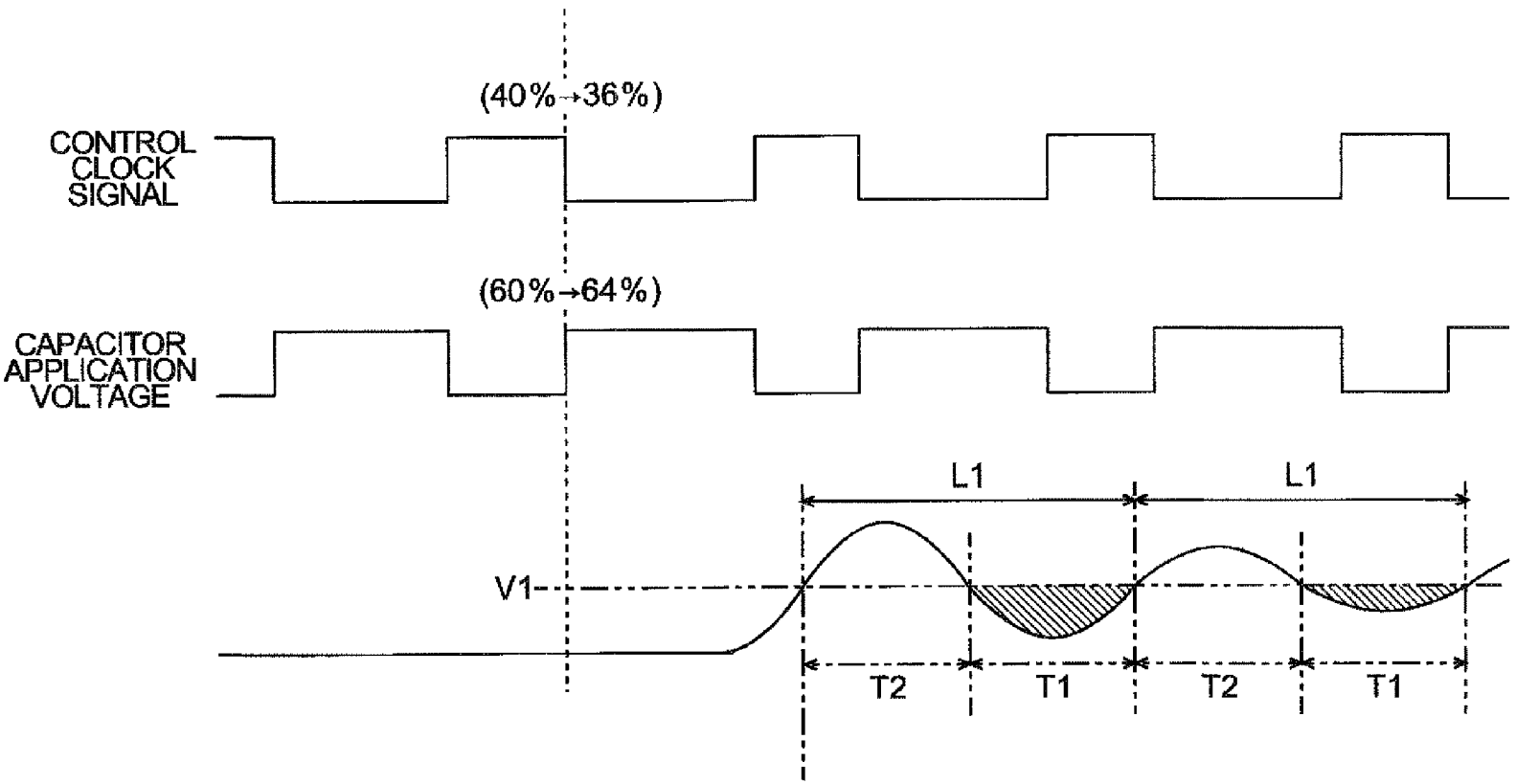
FIG. 9 is an explanatory diagram for describing a time slot for changing the duty ratio.

Next, with reference to FIG. 9, a time slot for changing the duty ratio is described. FIG. 9 is an explanatory diagram for describing the time slot for changing the duty ratio.

As described above, in this embodiment, the duty ratio of the control clock signal S1 is changed step by step so as to change the duty ratio of the voltages to be applied to the capacitor 81 and the voltage to be applied to the developing roller 11. As time after the duty ratio is changed is longer, it becomes harder for magnetic saturation to occur in the transformer 82. Therefore, it is preferred to quickly change the duty ratio accompanying the transition from the developing execution mode to the first mode or the transition from the first mode to the developing execution mode.

When the duty ratio is changed step by step, it is necessary to prevent large current from flowing in the first transistor 93 and to reach quickly to the target duty ratio. Here, the inventor experimentally recognized that there is a time slot (hereinafter, referred to as a "first time slot T1") in which large current flows in the first transistor 93 when changing the duty ratio in the next step (in the second or later duty ratio change) after the duty ratio is changed.

This first time slot T1 is described with reference to FIG. 9. A chart in the uppermost part of FIG. 9 illustrates a waveform of the control clock signal S1 (voltage to be applied to the developing roller 11). In FIG. 9, the duty ratio of the control clock signal S1 is changed from approximately 40% to approximately 36% at time point of a broken line (the description below is true also in the case where the duty ratio is changed from 40% to 38% by a step of 2%, as an example of the transition from the developing execution mode to the first mode).

In addition, a second chart in FIG. 9 illustrates a voltage waveform applied to the capacitor 81. In FIG. 9, the duty ratio of the voltage applied to the capacitor 81 is changed from approximately 60% to approximately 64% at a time point of a broken line (from 60% to 62% in a case where the step is 2%, as an example of transition from the developing execution mode to the first mode).

By this duty ratio change, a variation occurs in the voltage between electrodes of the capacitor 81 (charge quantity stored in the capacitor 81). For instance, as illustrated in FIG. 9, when the duty ratio of the voltage applied to the capacitor 81 is increased, the voltage between electrodes of the capacitor 81 is apt to increase.

Then, a lowermost chart in FIG. 9 illustrates a variation of the voltage value between electrodes of the capacitor 81. When the duty ratio is changed, the voltage between electrodes of the capacitor 81 oscillates at a constant period L1 due to oscillation with the primary coil 821 of the transformer 82. Then, the amplitude is gradually decreased so as to converge to a median V1 of the variation (amplitude) in the period L1. In FIG. 9, the variation period is indicated by L1.

Then, it is also experimentally known that if the duty ratio is changed in a bottom part of the voltage value between electrodes of the capacitor 81 in the oscillation (illustrated by hatching in FIG. 9), large current is apt to flow in the first transistor 93. In other words, the time slot in which the voltage value between electrodes of the capacitor 81 is smaller than the median V1 of the variation (amplitude) is a first time slot T1.

The mechanism and reason of flowing large current in the first transistor 93 are not clear but can be considered as follows. In view of energy oscillation between the capacitor 81 and the transformer 82, the state where the voltage value of the capacitor 81 is small is a state where energy has moved to the transformer 82 side and hence the asymmetric magnetization may have become large. In such the state, if the duty ratio is further changed so that a cause to increase the voltage of the capacitor 81 is generated, more asymmetric magnetization may be caused. In addition, it is also considered that magnetic saturation is generated easily by further application of clock. These factors may contribute the large current flowing in the first transistor 93.

Therefore, in this embodiment, after the duty ratio is changed, in the next step of changing the duty ratio, the control signal generating portion 91 changes the duty ratio of the control clock signal S1 in a second time slot T2 in the period L1. It is because if the duty ratio is changed in the first time slot T1, large current may flow in the first transistor 93.

Here, it is possible to determine the period L1 of voltage variation between electrodes of the capacitor 81 when the duty ratio is changed, by actual measurement in advance. In addition, it is also possible to determine which time slot in the period L1 is regarded as the first time slot T1, and which time slot in the period L1 is regarded as the second time slot T2, by actual measurement in advance.

In addition, because the variation of the voltage between electrodes of the capacitor 81 is related to a resonance phenomenon, it is possible to determine the resonance frequency from a capacitance (F) of the capacitor 81 and an inductance value (H) of the primary coil 821 of the transformer 82 (by the formula: resonance frequency=$\frac{1}{2}\pi\sqrt{LC}$ (Hz)), and to decide that the period L1 determined as the reciprocal of the resonance frequency is the period L1 of the voltage variation between electrodes of the capacitor 81 when the duty ratio is changed. For instance, when L is 1.5 mH and C is 150 μF, the period L1 becomes approximately 3 ms. In addition, based on the period L1 determined by the calculation, it is possible to decide that a first half of the period, namely approximately 1.5 ms is the second time slot T2, and that a second half, namely approximately 1.5 ms is the first time slot T1.

Further, data for changing the duty ratio, which include data indicating a length of the period L1 of the voltage variation between electrodes of the capacitor 81 when the duty ratio is changed, data about a start point of the period L1 indicating which time point should be the start point of the period L1 after the duty ratio is changed, data indicating a range of the first time slot T1 in the period L1, and data indicating a range of the second time slot T2 in the period L1, are stored in a memory 91M disposed in the control signal generating portion 91 or the like (see FIG. 4). Note that as illustrated in FIG. 3, the data for changing the duty ratio may be stored in the storage portion 73.

Then, the switching portion 9 (the control signal generating portion 91) determines whether or not to be the second time slot T2 using time from changing the duty ratio and data in the memory 91M or in the storage portion 73. Therefore, it is possible to dispose a timer for measuring time in the switching portion 9.

In addition, instead of the switching portion 9, the control portion 6 may measure time so as to decide whether or not to be the second time slot T2. In this case, a time point when the duty ratio was changed before is informed to the control portion 6, and the control portion 6 informs the switching portion 9 (the control signal generating portion 91) about having reached the second time slot T2 and about finishing the second time slot T2. Based on this information, the control signal generating portion 91 changes the duty ratio of the control clock signal S1 to the next step of duty ratio.

In this way, the switching portion 9 (the control signal generating portion 91) utilizes the time after changing the duty ratio and the data stored in the memory 91M or in the storage portion 73 so as to decide whether or not to be the second time slot T2. Then, the switching portion 9 changes the duty ratio to the next step during the decided second time slot T2. In this way, it is possible to prevent large current from flowing in the first transistor 93 and to quickly reach the target duty ratio.

Note that the example described above describes the case where the duty ratio of the control clock signal S1 is decreased so that the duty ratio of the voltage applied to the developing roller 11 is decreased (the duty ratio of the voltage applied to the capacitor 81 is increased), and the first time slot T1 and the second time slot T2 are determined based on the periodically fluctuated voltage value applied to the capacitor 81 and conductance of current in the first transistor 93. Further, also in a case where the duty ratio of the control clock signal S1 is increased so that the duty ratio of the voltage applied to the capacitor 81 is decreased and the duty ratio of the voltage applied to the developing roller 11 is increased, large current is apt to flow easily in the first time slot T1 (in the bottom part of the variation). Therefore, the same first time slot T1 and the same second time slot T2 are used both in the case where the duty ratio of the control clock signal S1 is decreased and in the case where the duty ratio of the control clock signal S1 is increased, and hence the duty ratio is changed in the second time slot T2. However, it is possible that the first time slot T1 and the second time slot T2 are respectively different between the case where the duty ratio of the control clock signal S1 is increased and the case where the same is decreased.

(Process Flow when Duty Ratio is Changed)

Figure 10:
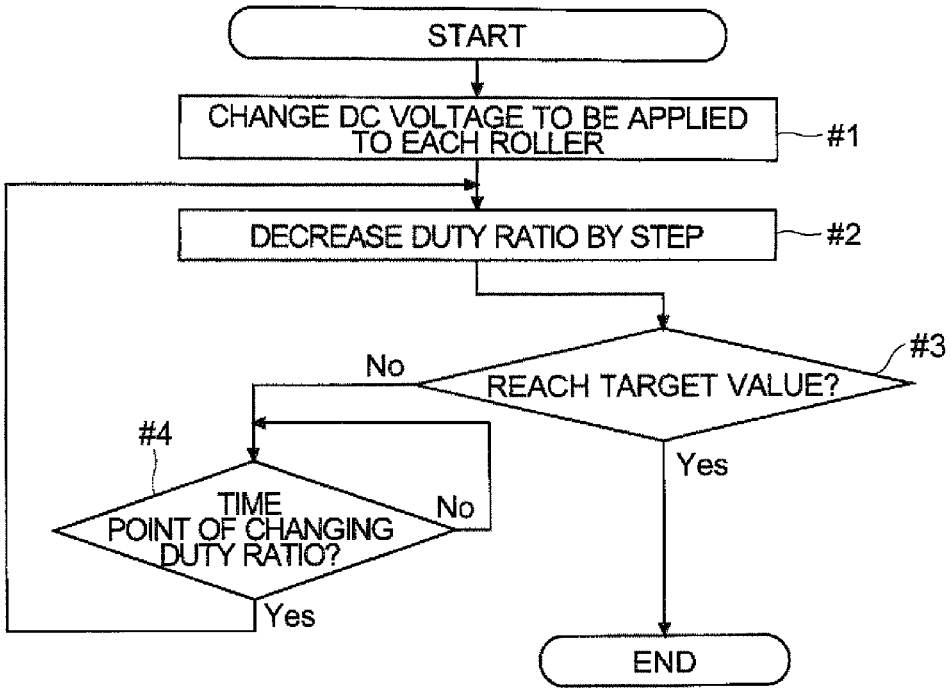

Next, with reference to FIG. 10, an example of a process flow when changing the duty ratio of the control clock signal S1 or the like is described. FIG. 10 is a flowchart illustrating an example of a process flow when changing the duty ratio of the control clock signal S1 or the like. Note that in the developing device 1 of this embodiment, a case of changing from the developing execution mode to the first mode or the second mode, or a case of changing from the first mode or the second mode to the developing execution mode, corresponds to the time when the duty ratio is changed.

A start of the process of FIG. 10 is a time point when the control portion 7 instructs the control signal generating portion 91, the developing roller bias portion 83, and the magnetic roller bias portion 84 to change from the developing execution mode to the first mode or the second mode, or to change from the first mode or the second mode to the developing execution mode.

When the instruction to change from the developing execution mode to the first mode or the second mode, or to change from the first mode or the second mode to the developing execution mode is issued, the developing roller bias portion 83 changes the DC voltage to be applied to the developing roller 11, and the magnetic roller bias portion 84 changes the DC voltage to be applied to the magnetic roller 12 (Step #1). Note that if the bias to be applied to the developing roller 11 or the magnetic roller 12 is not changed, Step #1 is not necessary.

Next, the control signal generating portion 91 changes the duty ratio of the control clock signal 51 by a predetermined step (Step #2). Note that when changing from the developing execution mode to the first mode or the second mode, the duty ratio of the control clock signal 51 is decreased. In addition, when changing from the first mode or the second mode to the developing execution mode, the duty ratio of the control clock signal 51 is increased. The step of the duty ratio may be changed. As a result, the duty ratio of the voltage applied to the capacitor 81 and the duty ratio of the voltage to be applied to the developing roller 11 are also changed. Then, the control signal generating portion 91 checks whether or not the duty ratio has reached the target duty ratio (Step #3).

If the duty ratio has reached the target duty ratio (Yes in Step #3), this flow is finished (END). Further, the control signal generating portion 91 and the control circuit portion 92 maintain the duty ratio and perform switching of the first transistor 93 until the instruction to change the mode or the instruction not to apply is received from the control portion 7.

On the other hand, if the duty ratio has not reached the target duty ratio yet (No in Step #3), the control signal generating portion 91 continues to check whether or not the time has reached a time point when the duty ratio can be changed next by the step (Step #4, No in Step #4 to Step #4). For instance, the control signal generating portion 91 includes a timer inside, and has a time measuring function. Then, the control circuit portion 92 changes the duty ratio first, and then checks whether or not the time has reached a time point when the duty ratio should be changed by the step.

Specifically, after changing the duty ratio first, the control signal generating portion 91 checks whether or not the time has reached the second time slot T2 in the period L1 of voltage variation between electrodes of the capacitor 81. The control signal generating portion 91 may decide Yes in Step #4 at a first second time slot T2 after the duty ratio is changed, or may decide Yes in Step #4 at a second time slot T2 of the second or later time after the duty ratio is changed, because it is considered that the voltage fluctuation range between electrodes of the capacitor 81 reduces. If the time reaches a time point in which the duty ratio is changed next by an step (Yes in Step #4), the flow goes back to Step #2.

When the duty ratio is changed, the voltage between electrodes of the capacitor 81 is oscillated with the period L1 (amplitude is increased and decreased in a sine wave) so as to be stabilized. It is experimentally known that there is a timing at which large current flows in the switching portion 9 (the first transistor 93 as the switching element) if the duty ratio is changed in this period L1.

Therefore, the developing device 1 of this embodiment includes the developing roller 11, the magnetic roller 12, the capacitor 81, the transformer 82, and the switching portion 9. The developing roller 11 carries the toner and is opposed to the photosensitive drum 42. The magnetic roller 12 is disposed to be opposed to the developing roller 11 so as to supply toner to the developing roller 11 and to take off the toner from the developing roller 11 with the magnetic brush. The transformer 82 is connected to the capacitor 81 in the primary and outputs the alternating voltage to be applied to the developing roller 11 from the secondary. The switching portion 9 includes the control signal generating portion 91 for generating the control signal (control clock signal S1), and the switching element (first transistor 93) connected to the capacitor 81 so as to make and break current to the serial circuit 85 of the capacitor 81 and the transformer 82 based on the control signal. In addition, when the switching portion 9 changes the duty ratio of the control signal successively step by step in a plurality of times toward the target duty ratio, the switching portion 9 changes the duty ratio in a predetermined second time slot T2 in which current flowing in the switching portion 9 is smaller than that in the first time slot T1 during the period L1 of the voltage variation between electrodes of the capacitor 81 due to the duty ratio change after the duty ratio is changed.

In this way, even if the voltage between electrodes of the capacitor 81 is periodically oscillating after the duty ratio is changed, it is possible to change to the next duty ratio at the timing when large current does not flow in the switching element (first transistor 93). Therefore, the switching element is not broken down, and hence it is possible to change safely the duty ratio to a desired value without breaking down the switching element.

In addition, it is experimentally known that large current flows in the switching element (first transistor 93) if the duty ratio is changed in a period in which the voltage between electrodes of the capacitor 81 is small in the state where energy is oscillating between the capacitor 81 and the primary coil of the transformer (primary coil 821). Although a mechanism thereof is not completely elucidated, when the charged capacitor 81 and the coil are connected, current usually starts to flow in the coil so that voltage of the capacitor 81 is decreased. In this way, if the duty ratio is changed in the state where the power is moving from the capacitor 81 to the coil (the primary of the transformer 82), the voltage between electrodes of the capacitor 81 is further increased, which may cause the large current flowing in the switching portion 9.

Therefore, the predetermined first time slot T1 is a time slot in which the voltage between electrodes of the capacitor 81 is smaller than the median V1 of the fluctuation range. In addition, the predetermined second time slot T2 is a time slot in which the voltage between electrodes of the capacitor 81 is the median V1 of the fluctuation range or higher. The switching portion 9 changes the duty ratio of the control signal (control clock signal S1) in the second time slot T2. In this way, it is possible to change the duty ratio in the time slot that is experimentally known as a time slot in which large current hardly flows in the switching element (first transistor 93). Therefore, it is possible to safely and quickly change the duty ratio to a desired value without breaking down the switching element.

In addition, the period L1 is a period of the resonance frequency determined from a capacitance of the capacitor 81 and an inductance of the transformer 82. In this way, it is possible to determine the switching timing of the duty ratio in the second or later time by calculation based on the capacitance and the inductance. Therefore, in consideration of variations of the components in the transformer 82 and the capacitor 81, it is possible to prevent large current from flowing in the switching element (first transistor 93) and to reach the target duty ratio in a shortest time.

In addition, when changing the duty ratio of the control signal (control clock signal S1) step by step in a plurality of times, the switching portion 9 changes the duty ratio every time when reaching the next second time slot T2 after the duty ratio is changed. In this way, the duty ratio is changed to the next duty ratio when reaching the second time slot T2, and it is possible to change to the target duty ratio in short time without breaking down the switching element (first transistor 93) by large current.

In addition, there is a case where unevenness of a toner image can be appropriately eliminated by applying voltages having different duty ratios to the capacitor 81 in the printing state and in the non-printing state. In addition, there is a case where leakage can hardly occur between the developing roller 11 and the photosensitive drum 42. Therefore, the switching portion 9 uses different duty ratio of the control signal (control clock signal S1) between the developing execution mode in which the electrostatic latent image formed on the photosensitive drum 42 is developed and the developing unexecuted mode in which the electrostatic latent image formed on the photosensitive drum 42 is not developed. The duty ratio in the developing execution mode is set larger than that in the developing unexecuted mode. When the developing execution mode is changed to the developing unexecuted mode, the switching portion 9 decreases the duty ratio step by step in a plurality of times from the duty ratio in the developing execution mode to the duty ratio in the developing unexecuted mode. When the developing unexecuted mode is changed to the developing execution mode, the switching portion 9 increases the duty ratio step by step in a plurality of times from the duty ratio in the developing unexecuted mode to the duty ratio in the developing execution mode. In this way, it is possible to appropriately elimination unevenness of the toner image and to make leakage hardly occur.

In addition, the switching portion 9 changes the duty ratio at the same timing between the case where the duty ratio is changed in a plurality of times so that the duty ratio of the control signal (control clock signal S1) is increased and the case where the duty ratio is changed in a plurality of times so that the duty ratio is decreased. In this way, the duty ratio should be changed at the same timing (time slot) between the case where the duty ratio is increased and the case where the duty ratio is decreased. Therefore, it is possible to unify the way of the duty ratio and to facilitate the control of the duty ratio.

In addition, the switching element is a transistor, which applies a voltage to the capacitor 81 at a duty ratio of a logical inversion of the clock signal output from the control signal generating portion 91. The transformer 82 generates an alternating voltage having an inverted logic of the duty ratio of the voltage applied to the capacitor 81 and applies the voltage to the developing roller 11. In this way, it is possible to apply the alternating voltage having the same duty ratio as the clock signal output from the control signal generating portion 91 to the developing roller 11 via the capacitor 81, the primary of the transformer 82, and the secondary of the transformer 82. Therefore, by adjusting the duty ratio of the control signal, it is possible to adjust the duty ratio of the voltage to be applied to the developing roller 11.

In addition, the image forming apparatus (for example, the printer 100) includes the developing device 1 described above. In this way, the image forming apparatus includes the developing device 1 that can change the duty ratio safely to a desired duty ratio without breaking down the switching element (first transistor 93). Therefore, without malfunction of the developing device 1, the duty ratio can be smoothly changed between the case where the toner image is being developed and the case where the toner image is not being developed. Therefore, it is possible to provide the image forming apparatus that can provide high image quality without unevenness of a toner image and does not cause a problem due to occurrence of leakage.

In addition, the switching portion 9 decides whether or not a current time slot is the second time slot T2 by utilizing the time after the duty ratio is changed and the data for changing the duty ratio stored in the memory 91M. Then in the case where decided second time slot T2, the duty ratio of the control signal (control clock signal S1) is changed to the next step duty ratio during this time slot that the switching portion has decided to be the second time slot. The data for changing the duty ratio stored in the memory 91M includes data indicating a length of the period L1, data about the start point of the period L1 indicating which time point should be the start point of the period L1 after the duty ratio is changed, data indicating the range of the first time slot T1 in the period L1, and data indicating the range of the second time slot T2 in the period L1. In this way, it is possible to change the duty ratio of the control signal securely during the second time slot T2 in which there is little probability of break-down of the switching element (first transistor 93) even if the duty ratio is changed.

In addition, the content of the above disclosure can be recognized also as a method.

The positively charged photosensitive drum 42 and toner are exemplified and described in the embodiment described above, but the present disclosure can be also applied to a case where a negatively charged photosensitive drum 42 and toner are used. In this case, the duty ratio should be determined so that the unevenness is decreased in the state where the developing is being executed for negatively charging (developing execution mode), while the duty ratio should be determined so that leakage does not occur in the state where developing is not being performed (developing inexecution mode).

The embodiment of the present disclosure is described above. However, the scope of the present disclosure is not limited to this, which can be embodied with various modifications within the scope of the disclosure without deviating from the same.

What is claimed is:

1. A developing device comprising:

a developing roller which carries toner and is disposed to be opposed to a photosensitive drum;

a magnetic roller disposed to be opposed to the developing roller so that the magnetic brush supplies the toner to the developing roller and takes off the toner from the developing roller;

a capacitor;

a transformer having a primary connected to the capacitor and a secondary which outputs an alternating voltage to be applied to the developing roller; and a switching portion including a control signal generating portion for generating a control signal, and a switching element connected to the capacitor so as to make and break current to a serial circuit of the capacitor and the transformer based on the control signal, wherein when the switching portion changes the duty ratio of the control signal step by step in a plurality of times toward a target duty ratio in a period after the change of the duty ratio in which the voltage between electrodes of the capacitor is changing, the switching portion changes the duty ratio in a predetermined second time slot in which current flowing in the switching portion is smaller than that flowing in a predetermined first time slot;

wherein, the predetermined first time slot is a time slot in which the voltage between electrodes of the capacitor is smaller than a median of a fluctuation range, the predetermined second time slot is a time slot in which the voltage between electrodes of the capacitor is the median of the fluctuation range or higher, and the switching portion changes the duty ratio of the control signal in the second time slot.

2. The developing device according to claim 1, wherein the period is a period of a resonance frequency determined from a capacitance of the capacitor and an inductance of the transformer.

3. The developing device according to claim 1, wherein when the switching portion changes the duty ratio of the control signal step by step successively in a plurality of times, the switching portion changes the duty ratio every time when the next second time slot comes after the duty ratio is changed.

4. The developing device according to claim 1, wherein the control signal generating portion makes the duty ratio of the control signal different between a developing execution mode in which an electrostatic latent image formed on the photosensitive drum is developed and a developing unexecuted mode in which the electrostatic latent image formed on the photosensitive drum is not developed, the duty ratio in the developing execution mode is larger than that in the developing unexecuted mode, when the developing execution mode is changed to the developing unexecuted mode, the switching portion decreases the duty ratio step by step in a plurality of times from the duty ratio in the developing execution mode to the duty ratio in the developing unexecuted mode, and when the developing unexecuted mode is changed to the developing execution mode, the switching portion increases the duty ratio step by step in a plurality of times from the duty ratio in the developing unexecuted mode to the duty ratio in the developing execution mode.

5. The developing device according to claim 1, wherein the switching portion changes the duty ratio of the control signal in the second time slot both in the case where the duty ratio is changed to increase in a plurality of times and in the case where the duty ratio is changed to decrease in a plurality of times.

6. The developing device according to claim 1, wherein the switching element is a transistor, which applies a voltage to the capacitor at a duty ratio of a logical inversion of the clock signal output from the control signal generating portion, and the transformer generates an alternating voltage having an inverted logic of the duty ratio of the voltage applied to the capacitor and applies the voltage to the developing roller.

7. The developing device according to claim 1, further comprising a memory for storing data for changing the duty ratio including data indicating a length of the period, data about a start point of the period indicating which time point should be a start point of the period after the duty ratio is changed, data indicating a range of the first time slot in the period, and data indicating a range of the second time slot in the period, wherein the switching portion decides whether or not a current time slot is the second time slot by utilizing a time after the duty ratio is changed and the data for changing the duty ratio stored in the memory, and changes the duty ratio of the control signal to a duty ratio of a next step during the time slot that the switching portion has decided to be the second time slot.

8. An image forming apparatus comprising the developing device according to claim 1.

9. A method for controlling a developing device, the method comprising the steps of:

permitting a developing roller opposed to the photosensitive drum to carry toner;

permitting a magnetic roller disposed to be opposed to the developing roller to supply the toner to the developing roller and to take off the toner from the developing roller, by using a magnetic brush;

connecting a capacitor to a primary of the transformer;

connecting to a secondary of the transformer so as to output an alternating voltage from the secondary of the transformer, so that the alternating voltage is applied to the developing roller;

permitting the control signal generating portion to generate a control signal;

permitting the switching element connected to the capacitor to make and break current to a serial circuit of the capacitor and the transformer based on the control signal;

constituting a switching portion of the control signal generating portion and the switching element; and when changing the duty ratio of the control signal step by step in a plurality of times successively toward the target duty ratio, after the duty ratio is changed, in a period while the voltage between electrodes of the capacitor is changing due to the duty ratio change, permitting the switching portion to change the duty ratio in a predetermined second time slot in which current flowing in the switching portion is smaller than that flowing in a predetermined first time slot wherein the predetermined first time slot is a time slot in which the voltage between electrodes of the capacitor is smaller than a median of a fluctuation range, the predetermined second time slot is a time slot in which the voltage between electrodes of the capacitor is the median of the fluctuation range or higher, and the method further comprises permitting the switching portion to change the duty ratio of the control signal in the second time slot.

10. The method for controlling a developing device according to claim 9, wherein the period is a period of a resonance frequency determined from a capacitance of the capacitor and an inductance of the transformer.

11. The method for controlling a developing device according to claim 9, the method further comprising, when changing the duty ratio of the control signal step by step successively in a plurality of times, permitting the switching portion to change the duty ratio every time when the next second time slot comes after the duty ratio is changed.

12. The method for controlling a developing device according to claim 9, the method further comprising:

permitting the control signal generating portion to generate the control signal so that the duty ratio of the control signal is different between a developing execution mode in which an electrostatic latent image formed on the photosensitive drum is developed and a developing unexecuted mode in which the electrostatic latent image formed on the photosensitive drum is not developed;

making the duty ratio in the developing execution mode larger than that in the developing unexecuted mode;

permitting the switching portion, when the developing execution mode is changed to the developing unexecuted mode, to decrease the duty ratio step by step in a plurality of times from the duty ratio in the developing execution mode to the duty ratio in the developing unexecuted mode; and permitting the switching portion, when the developing unexecuted mode is changed to the developing execution mode, to increase the duty ratio step by step in a plurality of times from the duty ratio in the developing unexecuted mode to the duty ratio in the developing execution mode.

13. The method for controlling a developing device according to claim 9, the method further comprising permitting the switching portion to change the duty ratio of the control signal in the second time slot both in the case where the duty ratio is changed to increase in a plurality of times and in the case where the duty ratio is changed to decrease in a plurality of times.

14. The method for controlling a developing device according to claim 9, wherein the switching element is a transistor, and the method further comprises:

applying a voltage to the capacitor at a duty ratio of a logical inversion of the clock signal output from the control signal generating portion;

permitting the transformer to generate an alternating voltage having an inverted logic of the duty ratio of the voltage applied to the capacitor; and applying the generated alternating voltage to the developing roller.

15. The method for controlling a developing device according to claim 10, the method further comprising:

permitting a memory to store data for changing the duty ratio including data indicating a length of the period, data about a start point of the period indicating which time point should be a start point of the period after the duty ratio is changed, data indicating a range of the first time slot in the period, and data indicating a range of the second time slot in the period;

permitting the switching portion to decide whether or not a current time slot is the second time slot by utilizing a time after the duty ratio is changed and the data for changing the duty ratio stored in the memory; and permitting the switching portion to change the duty ratio of the control signal to a duty ratio of a next step during the time slot that the switching portion has decided to be the second time slot.

* * * * *